US008043131B2

(12) United States Patent
Ngo

(10) Patent No.: US 8,043,131 B2
(45) Date of Patent: Oct. 25, 2011

(54) ELECTRICAL CABLE CONTACT

(75) Inventor: Hung Viet Ngo, Harrisburg, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/559,791

(22) Filed: Sep. 15, 2009

(65) Prior Publication Data

US 2010/0075528 A1 Mar. 25, 2010

Related U.S. Application Data

(60) Provisional application No. 61/098,625, filed on Sep. 19, 2008.

(51) Int. Cl.
*H01R 4/10* (2006.01)

(52) U.S. Cl. ..... 439/877; 439/881; 439/882; 439/878

(58) Field of Classification Search ..... 439/877, 439/881, 882, 878
See application file for complete search history.

(56) References Cited

U.S. PATENT DOCUMENTS

| | | | | |
|---|---|---|---|---|
| 318,186 | A | 5/1885 | Hertzog | |
| 2,759,163 | A | 8/1956 | Ustin et al. | |
| 2,762,022 | A | 9/1956 | Benander et al. | |
| 2,811,706 | A * | 10/1957 | Logan | 439/881 |
| 3,011,143 | A | 11/1961 | Dean | |
| 3,178,669 | A | 4/1965 | Roberts | |
| 3,208,030 | A | 9/1965 | Evans et al. | |
| 3,420,087 | A | 1/1969 | Hatfield et al. | |
| 3,514,740 | A | 5/1970 | Filson et al. | |
| 3,634,811 | A | 1/1972 | Teagno | |
| 3,748,633 | A | 7/1973 | Lundergan | |
| 3,845,451 | A | 10/1974 | Neidecker | |
| 3,972,580 | A | 8/1976 | Pemberton et al. | |
| 4,403,821 | A | 9/1983 | Zimmerman et al. | |
| 4,564,259 | A | 1/1986 | Vandame | |
| 4,900,271 | A | 2/1990 | Colleran et al. | |
| 4,950,186 | A * | 8/1990 | Kaley et al. | 439/882 |
| 4,963,102 | A | 10/1990 | Gettig et al. | |
| 4,973,271 | A | 11/1990 | Ishizuka et al. | |
| 5,016,968 | A | 5/1991 | Hammond et al. | |
| 5,024,610 | A | 6/1991 | French et al. | |
| 5,035,639 | A | 7/1991 | Kilpatrick et al. | |
| 5,104,332 | A | 4/1992 | McCoy | |
| 5,427,543 | A | 6/1995 | Dynia | |
| 5,445,535 | A * | 8/1995 | Phillips et al. | 439/877 |
| 5,458,426 | A | 10/1995 | Ito | |
| 5,975,965 | A * | 11/1999 | Jordan | 439/877 |
| 6,656,002 | B2 | 12/2003 | Zhao et al. | |
| 7,318,743 | B2 * | 1/2008 | Lu | 439/881 |

FOREIGN PATENT DOCUMENTS

| | | |
|---|---|---|
| DE | 1 665 181 | 4/1974 |
| DE | 10345202 A1 | 4/2005 |
| EP | 0 623 248 B1 | 11/1995 |
| EP | 0 789 422 A2 | 8/1997 |
| EP | 1 091 449 B1 | 9/2004 |
| JP | 2003-217785 | 7/2003 |

* cited by examiner

*Primary Examiner* — Tho D Ta
(74) *Attorney, Agent, or Firm* — Woodcock Washburn LLP

(57) ABSTRACT

A cable connector includes an electrical contact configured to receive a cable at one end, and an electrical component at another end. The contact can be constructed as a one-piece contact body or a two-piece contact body, and the contact body can include a cable lock that assists in retaining the cable in the contact body.

26 Claims, 17 Drawing Sheets

ELECTRICAL CABLE CONTACT

CROSS REFERENCE TO RELATED APPLICATIONS

This application claims the benefit of U.S. Provisional Application No. 61/098,625 filed on Sep. 19, 2008, the disclosure of which is hereby incorporated by reference as if set forth in its entirety herein.

Reference is made to PCT publication Nos. WO2007009486 and WO2007059798, and U.S. patent application Ser. No. 12/054,023, the disclosures of each of which are hereby incorporated by reference as if set forth in their entirety herein.

FIELD OF THE INVENTION

The present invention relates generally to the field of electrical connectors, in particular relates to a cable connector.

BACKGROUND

Electrical connectors provide signal and/or power connections between electronic devices using signal contacts. Cable connectors facilitate electrical connections from a cable to an electrical component, which in some instances can be an electrical connector configured for connection to a substrate, such as a printed circuit board 43.

Referring to FIG. 1A, a conventional cable connector 20 includes a connector housing 22 that defines first and second inputs 24 and 26 that respectively receives a corresponding cable 28 and 30. A pair of crimp sleeves 32 and 34 can be associated with the corresponding pair of inputs 24 and 26, and extend into the housing 22. Each crimp sleeve 32 and 34 is crimped onto respective cables 28 and 30 at one end to secure the corresponding cable in the respective input, and welded at joints 35 and 37 to a receptacle 36 and 38, respectively, at their opposing end. Thus, the crimp sleeves 32 and 34 can establish an electrical connection between each cable 28 and 30 and a header 41 of an electrical component 40 that is received in the corresponding receptacle 36 and 38. The electrical component 40 can be in the form of a connector (a right-angle connector as illustrated) that is configured to attach to a printed circuit board 43. In this manner, electrical signals or power is communicated from each cable 28 and 30 to the circuit board 43. As shown in FIGS. 1A and 1B, the connector 20 can be oriented as a right-angle or vertical cable connector.

While such connectors have proven suitable for their intended purpose, it would be desirable to provide a cable connector having a simplified construction.

SUMMARY

In accordance with one embodiment, an electrical contact body defines a first end configured to mate with a cable and a second end configured to mate with an electrical component so as to place the cable in electrical communication with the electrical component. The contact body includes a first segment defining a first portion of the first end and a first portion of the second end, a second segment defining a second portion of the first end and a second portion of the second end, and a cable lock configured to retain the cable in the sleeve. At least one of the segments is a one-piece segment, and the first and second segments are attached such that the first end defines a sleeve configured to receive a cable.

DETAILED DESCRIPTION

Figure 2A:
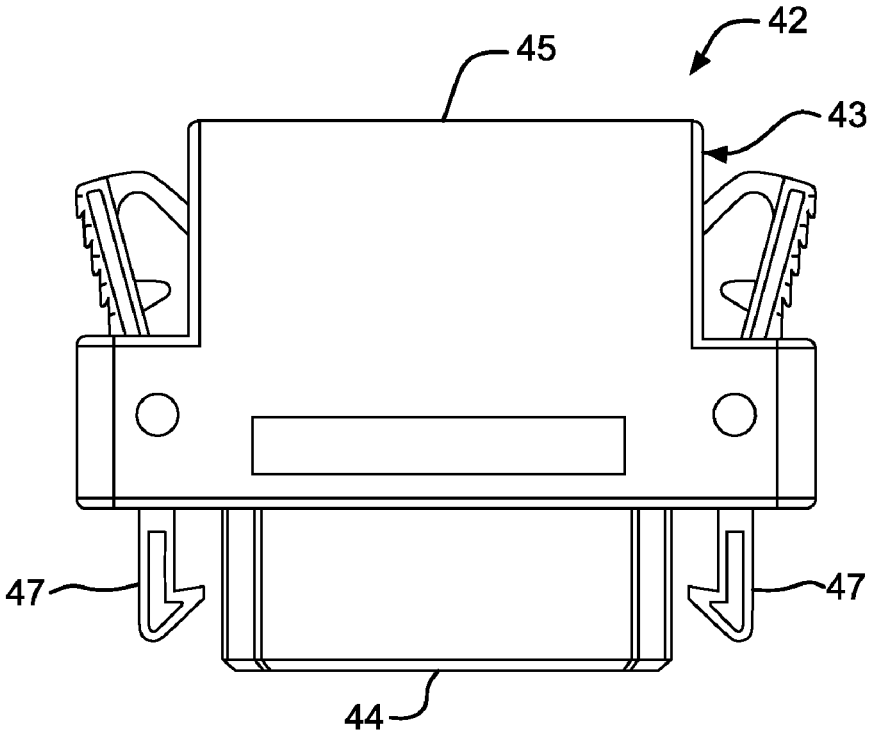
FIG. 2A is a top plan view of an electrical connector including a housing and an electrical contact constructed in accordance with one embodiment.
Figure 2B:
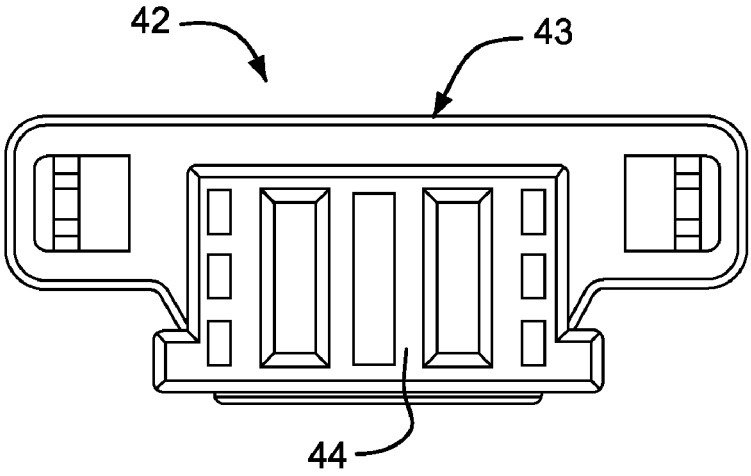
FIG. 2B is a front elevation view of the mating end of the electrical connector illustrated in FIG. 2A.

Referring to FIGS. 2A-B, an electrical cable connector 42 is provided for electrically connecting a cable to an electrical component. The connector 42 includes a dielectric housing 43 that at least partially surrounds an electrical contact 50 (see FIG. 4A, though any suitable contact of the type described herein could be incorporated). The housing 43 can be formed from insulating plastic or any suitable dielectric material, and can be overmolded onto the contact 50. In the illustrated embodiment, the connector 42 includes a mating end 44 adapted to mate with an electrical component, and a mounting end 45 which is provided as a cable-interface end that is configured to mate with a cable. The connector 42 can include a pair of spring-loaded latch arms 47 that are configured to interlock the housing 43 with a complementary housing of the electrical component once the electrical component has been mated with the connector 42.

Figure 3A:
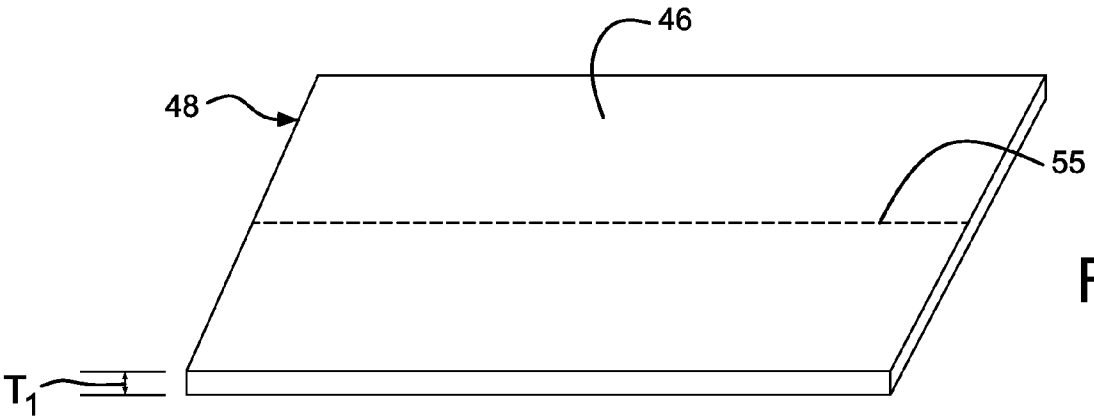
FIG. 3A is a perspective view of a blank of sheet metal that can be used to construct an electrical contact or segments of an electrical contact of the electrical connector illustrated in FIGS. 2A-B in accordance with one embodiment.
Figure 3B:
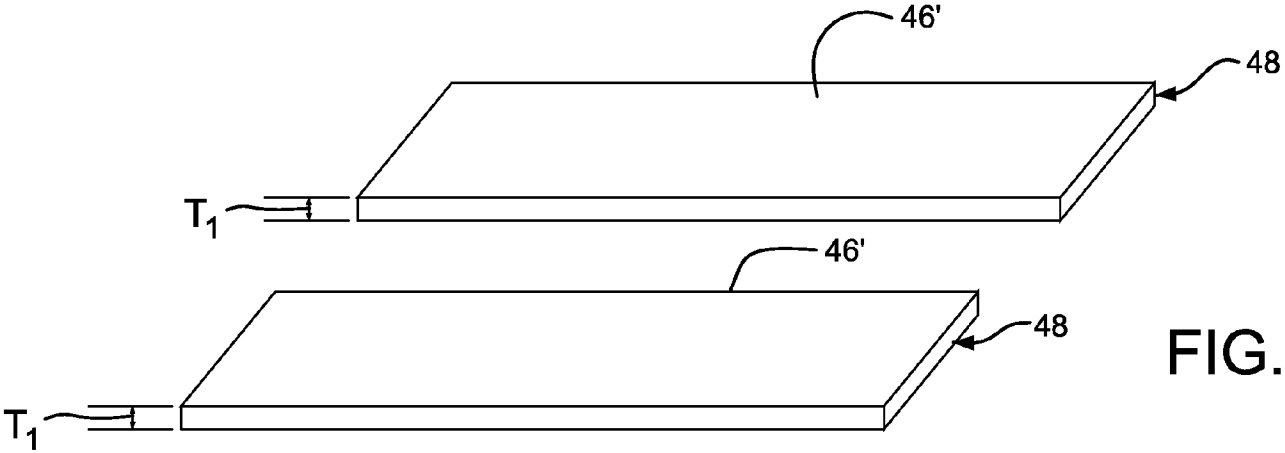
FIG. 3B is a perspective view of two blanks of sheet metal that can be used to construct segments of an electrical contact of the electrical connector illustrated in FIGS. 2A-B in accordance with an alternative embodiment.

Referring now to FIG. 3A, a blank 46 of sheet metal 48 can be provided having a thickness "$T_1$". The blank can undergo a series of bending, cutting, and forming (e.g., stamping) operations to create the various components of the contact 50 as described in more detail below. For instance, the blank 46 can be folded about a joint 55 to create first and second contact body segments 52A and 52B. Alternatively, as illustrated in FIG. 3B, a pair of blanks 46' can be provided and can undergo a series of bending and forming operations to create individual contact body segments which are subsequently joined to each other to create the contact 50. The blanks 46' can be identically or substantially identically constructed.

Figure 4A:
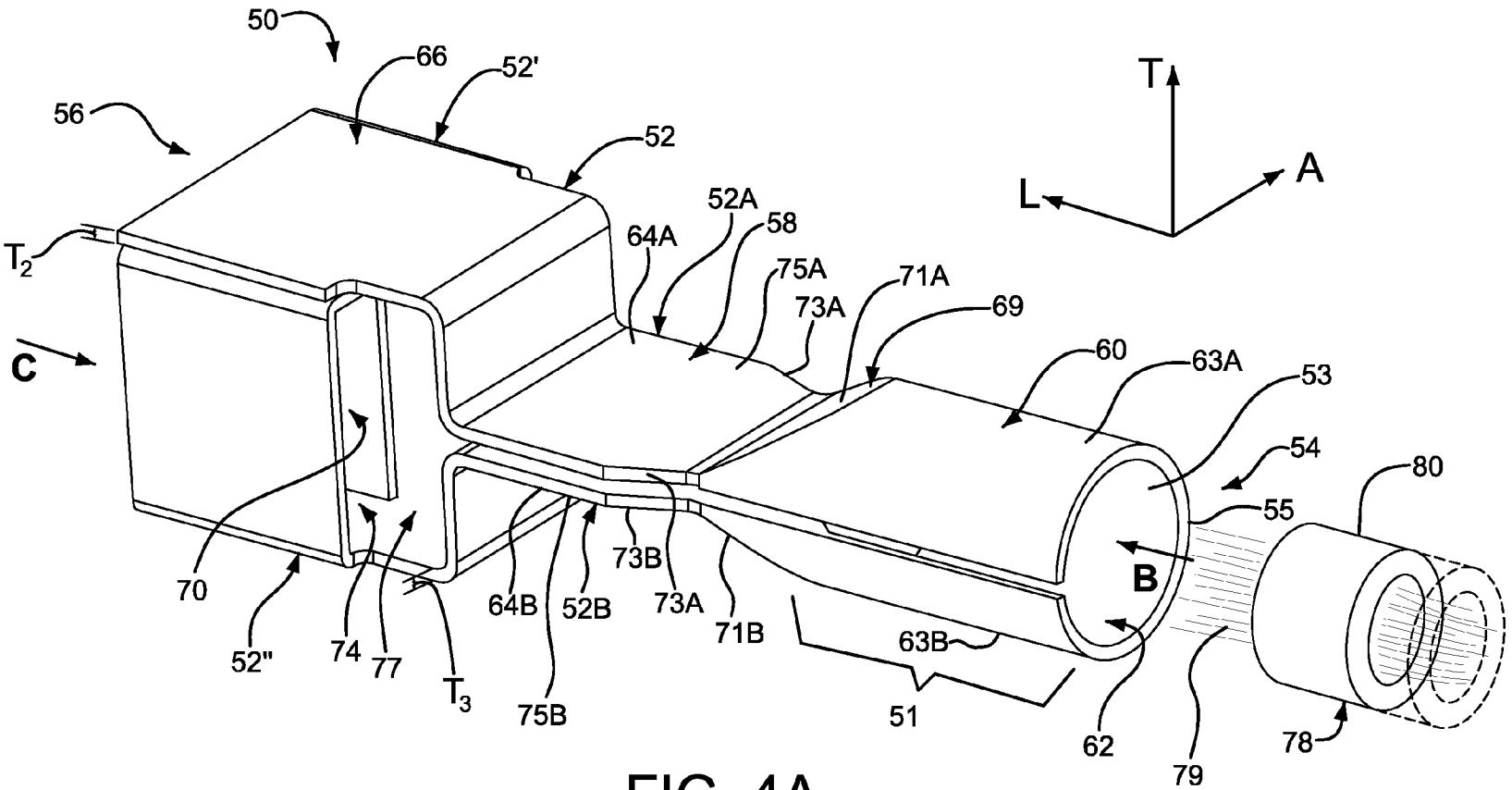
FIG. 4A is a perspective view of a vertical cable contact that can be constructed from the blank sheet of metal as illustrated in FIG. 3A in accordance with one embodiment.
Figure 4B:
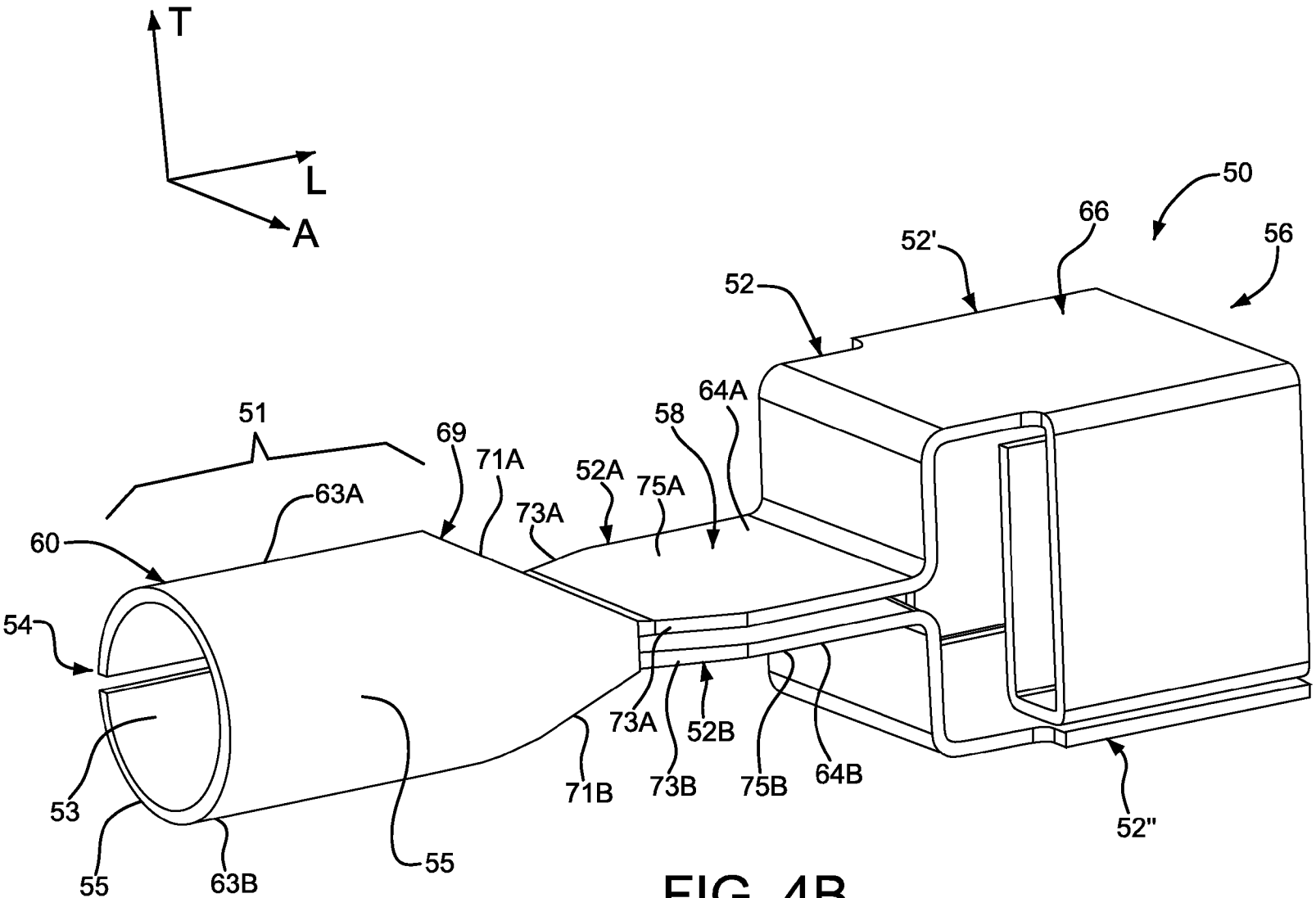
FIG. 4B is another perspective view of the vertical cable contact illustrated in FIG. 4A.
Figure 4C:
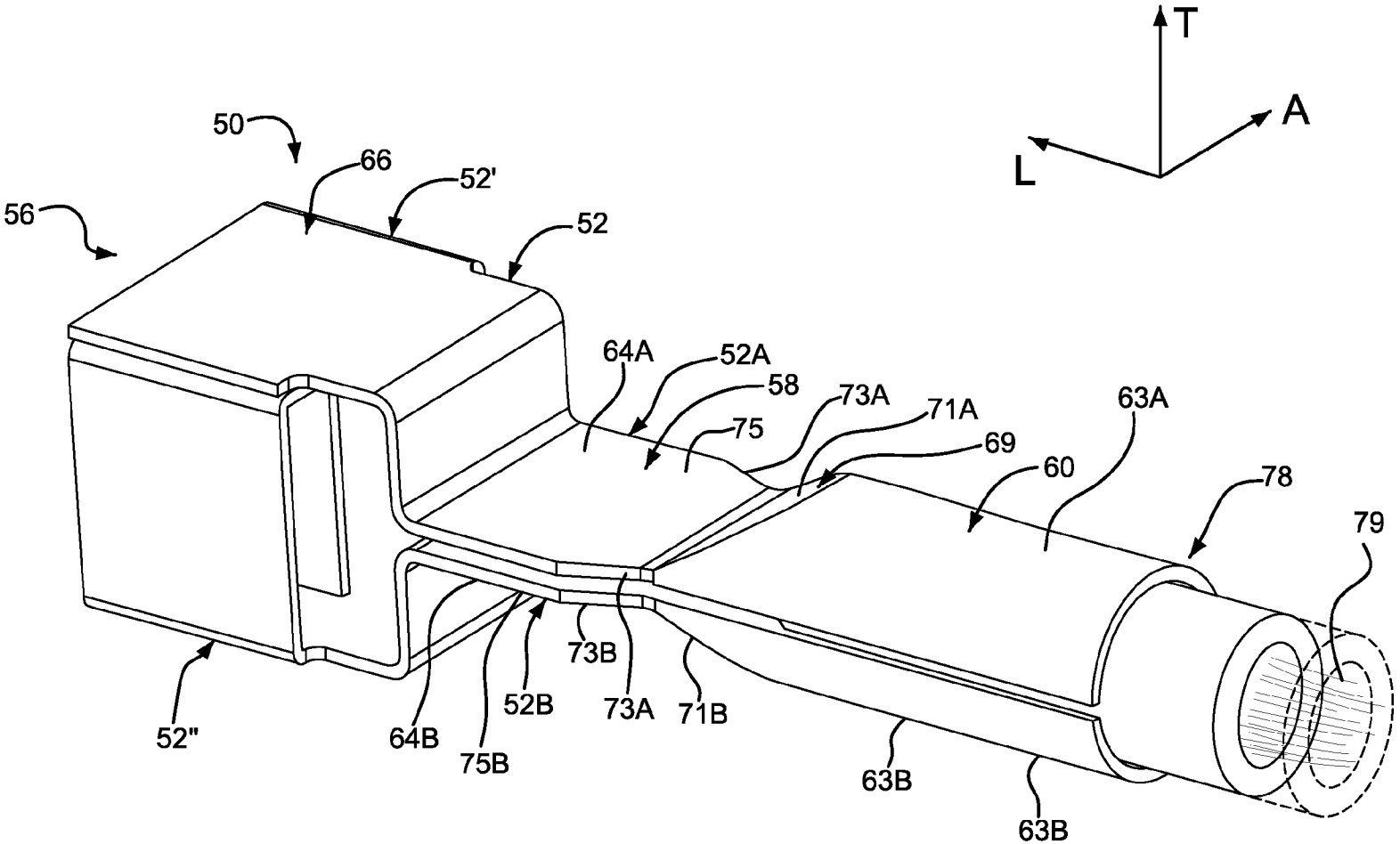
FIG. 4C is a perspective view of the cable contact illustrated in FIG. 4A connected to a cable.

Referring now to FIGS. 4A-C, the electrical cable contact 50 for use in the cable connector 42 is provided for connecting a cable 78 to an electrical component, which can be in the form of an electrical connector that in turn attaches to a printed circuit board, such as the circuit board 43. The contact 50 defines a contact body 52 having a first cable-interface end 54 (which can be coincident with, or proximal to, the mounting end 45 of the connector housing 43), an opposing second mating end 56 (which can be coincident with, or proximal to, the mating end 44 of the connector housing 43), and a junction 58 connected between the first and second ends 54 and 56. The cable contact 50 is a vertical or "straight" contact, such that the cable-interface end 54 extends in a direction parallel with the mating end 56. Unless otherwise specified, the contact body 52 and its components can be fabricated from a conductive metal such as copper, phos-bronze, or can alternatively be fabricated from any suitable conductive material. The ends 54 and 56, and the junction 58, are electrically conductive so as to place the mating end 56 in electrical communication with the cable interface end 54. The cable interface end 54 can include a sleeve 60 configured to receive a cable, while the mating end can include a pair of cavities, as is described in more detail below. The contact body 52 can be covered with an insulating dielectric material as desired.

The contact body 52 is illustrated as extending horizontally along a longitudinal direction "L" and lateral direction "A", and vertically along a transverse direction "T". The contact body 52 and its components, including the cable-interface end 54, the opposing second mating end 56, and the junction are elongate in the longitudinal direction L. Unless otherwise specified herein, the terms "lateral," "longitudinal," and "transverse" as used to describe the orthogonal directional components of the electrical contact 50 and its components. The terms "inboard" and "inner," and "outboard" and "outer" with respect to a specified directional component are used herein with respect to a given apparatus to refer to directions along the directional component toward and away from the center apparatus, respectively. The terms "downstream" and "upstream" and derivatives thereof refer to a longitudinal direction from the first end 54 toward the second end 56, and a longitudinal direction from the second end 56 toward the first end 54, respectively.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the desired orientation of the components of the contact body 52. Accordingly, the terms "vertical" and "horizontal" are used to describe the contact 50 as illustrated merely for the purposes of clarity and convenience, it being appreciated that these orientations may change during use.

In the illustrated embodiment, the contact body 52 includes a first contact body segment 52A that is illustrated as defining an upper portion 52' of the contact body 52 and the various components of the contact body 52, and a second contact body segment 52B that is illustrated as defining a lower portion 52" of the contact body 52 and the various components of the contact body. Thus, the components of the first body segment 52A can be referred to as "first" components, while the components of the second body segment 52B can be referred to as "second" components. It should further be appreciated in accordance with the illustrated embodiments that the "first" components can likewise be referred to as "upper" components, while the "second" components can likewise be referred to as "lower" components. However, because the construction and orientation of the contact body 52 can differ from the illustrated embodiment without departing from the spirit and scope of the present invention as defined by the appended claims, the "first" components should not be construed as limited to "upper" components, and the "second" components should not be construed as limited to "lower" components.

The body segments 52A and 52B can be similarly or identically constructed and joined either discreetly or integrally to form the contact body 52. At least one, or both of, as illustrated, the first and second body segments 52A-B are integrally formed as a unitary structure. Thus, the contact body 52 can be formed from a unitary structure. Alternatively, the contact body 52 can be formed from several structures that are discretely connected together.

Thus, the body segments 52A and 52B each can be integrally formed as separate structures and then discretely connected together, or the body segments 52A and 52B can be integrally formed together from a single sheet of metal. In the embodiment where the body segments 52A and 52B are integrally formed together, for instance from a single blank of sheet metal, the contact body 52 can be referred to as a "one-piece" electrical contact body that forms a "one-piece" electrical contact 50.

In the instance where the contact body 52 is an integral unitary structure, the contact body segments 52A and 52B can be fabricated using a single sheet of metal, for instance by bending the sheet metal at joint 55 disposed between opposing sleeve segments 63A and 63B to create the sleeve 60. The joint 55 can extend longitudinally between the junction 58 and the longitudinally upstream end of the sleeve 60, though it should be appreciated that the joint 55 can alternatively be located anywhere, as desired, to integrally join the body segments 52A and 52B.

The components of the integrally constructed contact body 52 will now be described in more detail with continuing reference to FIGS. 4A-4C. It should be appreciated that reference numerals corresponding to various structure labeled with an "A" refers to structure of the first body segment 52A, while reference numerals corresponding to various structure labeled with a "B" refers to structure of the second body segment 52B. Because the body segments 52A and 52B are substantially identically or identically constructed, a description of a component of one of the segments applies to the corresponding structure of the other segment, unless otherwise specified. In this regard, it should be further appreciated that the components of the first body segment 52A are vertically inverted with respect to those of the second body segment 52B in the illustrated embodiment. It should also be appreciated that the structure of the contact body 52 is described herein in accordance with one embodiment, and that other suitable structure is contemplated as encompassed by the appended claims.

The cable-interface end 54 of the contact body 52 includes a sleeve 60 formed from opposing longitudinally extending arc-shaped bodies 63A and 63B. The bodies 63A-B can be arc-shaped so as to in combination impart a substantially tubular geometry to the sleeve 60 having a longitudinally elongate cavity 62 configured to receive fibers 79 of a cable 78 therein along the direction of Arrow B, thereby allowing the cable-interface end 54 to mate with the cable 78. Alternatively, the bodies 63A-B can be of any suitable shape to impart a corresponding alternative shape onto the sleeve 60. The sleeve 60 can receive the insulating sheath 80 to provide strain relief. Alternatively, the cable 78 can be devoid of individual cable fibers. Accordingly, a reference to the cable interface end 54 mating with a cable includes the instance where the cable interface end 54 mates with individual fibers, and further includes the instance where the cable interface end 54 mates with a cable.

The cavity 62 defines an opening 53 disposed at the longitudinally upstream end of the cavity 62, and that the opening 53 is adapted to receive the cable 78 as the cable is inserted into the cavity 62. It should be appreciated that the sleeve 60 can include a cable lock 161 of the type described below with respect to FIGS. 6A-C or FIGS. 8A-B. It should be further appreciated that the contact body 52 can include more than one sleeve 60 that is in electrical communication with the mating end 56, such that more than one cable can be placed in electrical communication with an electrical component mated with the contact 50 at the mating end 56.

With continuing reference to FIGS. 4A-4C, the contact body 52 includes a transition zone 69 in the form of a beveled section at its longitudinally downstream end. The transition zone 69 includes first and second plates 71A and 71B that neck transversely inward from each body 63A and 63B, respectively, in a longitudinally downstream direction toward the junction 58. In this regard, the transition zone 69 is connected between, and provides an interface between, the sleeve 60 and the junction 58. While the transition zone 69 is illustrated as being substantially flat, it should be appreciated that any alternatively shaped interface suitable for directly or indirectly joining the sleeve 60 and the junction 58 is contemplated.

Thus, the sleeve 60 defines a crimp zone 51 disposed between the transition zone 69 and the longitudinally upstream end of the sleeve 60. One or both of the sleeve segments 63A-B can be crimped against the cable 78 disposed in the cavity 162 to retain the cable 78 therein. For instance, the sleeve 60 can crimp against both the insulating sheath 80 and the cable fibers 79 to provide strain relief while maintaining an electrical connection with the cable fibers, or can crimp against only the cable fibers 79 as illustrated in FIGS. 9A-D.

The longitudinally downstream end of the transition zone 69 is connected to the junction 58. The junction 58 includes a pair of flat horizontal plates 64A and 64B at the first and second body segments 52A and 52B, respectively, whose respective first and second surfaces abut or are in close proximity (vertical proximity as illustrated). If desired, one of the laterally outer ends of the flat plates 64A and 64B can be joined to define a joint similar to the joint 55, and could be provided together with the joint 55 or in place of the joint 55. Each plate 64A and 64B includes a corresponding body portion 75A and 75B and transition zones 73A and 73B, respectively, provided in the form of beveled sections. The transition zones 73A and 73B are disposed longitudinally upstream from the body portions 75A and 75B, and flare laterally outward in a longitudinally downstream direction from the neck 69 toward the body portions 75A and 75B.

The longitudinally upstream ends of the transition zones 73A and 73B have a lateral width substantially equal to that of the sleeve 60, while the longitudinally downstream ends of the transition zones 73A and 73B have a lateral width substantially equal to that of the body portions 75A and 75B. Thus the body portions 75A and 75B have a lateral width greater than that of the sleeve 60, and substantially equal to that of the mating end 56. It should be further appreciated that the junction 58 can include a junction lock 97 of the type described below with respect to FIG. 5.

Figure 1B:
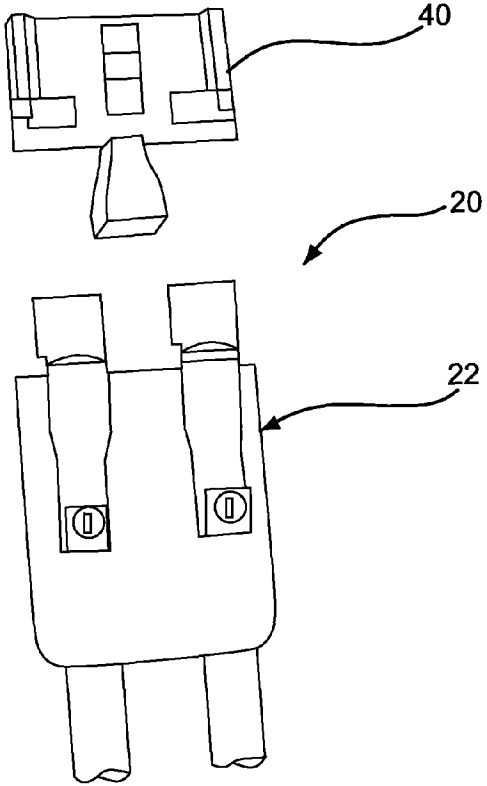
FIGS. 1A-B are perspective views of conventional cable connector assemblies.
Figure 1A:
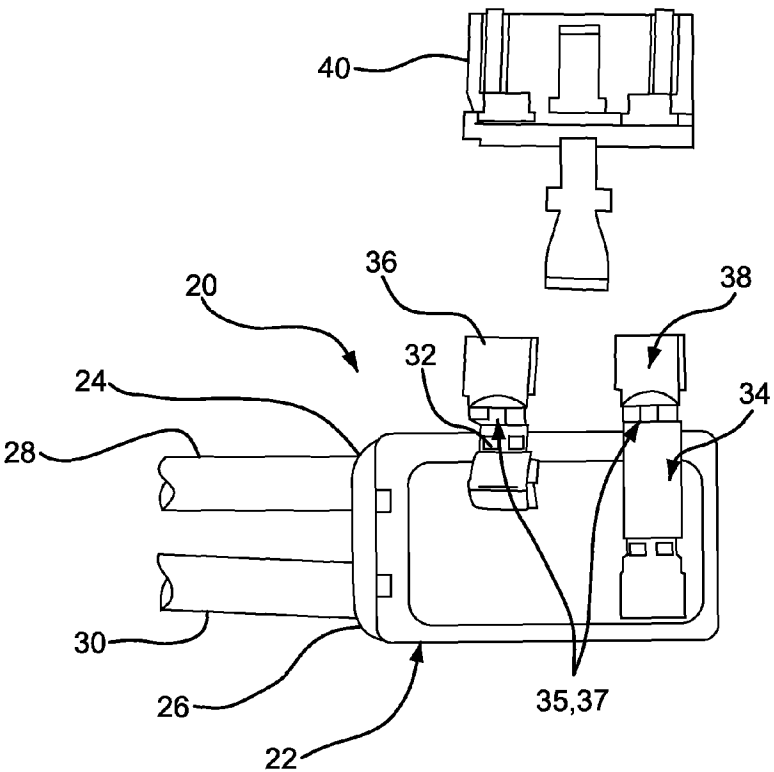

The mating end 56 includes a casing 66 that defines at least one chamber 77, which in turn is illustrated as being divided into a pair of cavities (cavity 74 shown in FIG. 4A) that in turn define corresponding receptacles (receptacle 70 shown in FIG. 4A). Each receptacle is configured to receive a mating end, for instance a header, of a corresponding external electrical component, such as the component 40 illustrated in FIGS. 1-2, or like component, in the longitudinal direction indicated by Arrow C.

The casing 66 can be constructed as described below with respect to the casing 166 illustrated in FIGS. 6A-C. Thus, it will be appreciated that the upper portion of the casing 66 is integral with the upper portion of the sleeve 60, and the lower portion of the casing 66 is integral with the lower portion of the sleeve 60. Furthermore, the upper and lower portions of the casing 66 can be integral with each other, for instance, when the upper and lower body segments 52A and 52B are integrally joined at the joint 55.

While the contact body 52 has been described as constructed in accordance with one embodiment, it should be appreciated that the contact body could be modified in one of numerous ways without departing from the spirit and scope of the invention as defined by the appended claims. For instance, the chamber 77 can be configured to include one or more than two receptacles so as to electrically connect any desired number of electrical components to the cable 78. Likewise, the mating end 56 can alternatively include headers, as opposed to receptacles, that are configured to mate with corresponding receptacles of the electrical component. Thus, when the mating end 56 is said to "mate" with a corresponding mating end of an electrical component, the mating end 56 can receive or be received in the mating end of the electrical component.

The operation of the electrical contact 50 will now be described with continuing reference to FIGS. 2-3. In particular, the cable 78 is inserted along the longitudinal direction indicated by Arrow B until the cable fibers 79 extending from the insulating sheath 80 (or the cable itself) are inserted into the cavity 62 of the sleeve 60. The crimp zone 51 of the sleeve 60 is then crimped onto the cable 78 to cause an interference that secures the cable 78 in the cavity 62, thereby forming a cable contact assembly 76, or cable connector assembly when the connector 42 illustrated in FIGS. 2A-B are connected to the cable 78 and electrical device 40 in the manner described herein. Once the sleeve 60 has been crimped against the cable 78, the crimp tabs 65 and 67 can be squeezed, pressed, crimped, or otherwise secured against the crimped sleeve 60 to resist separation of the sleeve segments 63A-B.

It should be appreciated that the crimp tabs 65 and 67 can also align the body segments 52A-B when the contact 50 is constructed. For instance, if the contact 50 is a one-piece contact, the crimp tabs 65 and 67 align the sleeve when the contact body 52 is folded about the joint 55. If the contact 50 is a two-piece contact as described below with reference to FIG. 5, the crimp tabs 65 and 67 align the contact bodies 52A-B when the contact bodies 52A-B are joined and locked in place using the junction lock 97.

Likewise, the header of an electrical component (such as the header 41 of the electrical component 40 or other suitable electrical component) can be inserted in each of the receptacles 68 and 70 which are geometrically configured to receive the headers.

It should thus be appreciated that the contact 50 is configured to electrically connect the cable 78 and an electrical component (such as the electrical component 40) in parallel (e.g., longitudinal) orientations. Because the receptacles of the casing 66 is integrally formed with the sleeve 60, once the cable 78 is secure in the sleeve 60, the cable is in electrical communication with the receptacles 68 and 70 and corresponding electrical devices 40 that are inserted into the receptacles 68 and 70, along with one or more circuit boards 43 that are connected to the electrical devices 40. Furthermore, a one-piece contact body 52 (or one-piece body segments 52A and 52B) can allow for improved electrical current flow as opposed to electrical contacts having portions that are discreetly connected (e.g., welded) to each other. Because the body segments 52A and 52B are formed from a sheet of metal, such as blank 46, the body segments 52A and 52B can each be constructed with a respective thickness $T_2$ and $T_3$ (see FIG. 3) defined as a dimension normal to the direction of extension of the various components of the body segments 52A and 52B. The body segments 52A and 52B, define respective thicknesses $T_2$ and $T_3$, which can be defined as dimensions normal to the direction of extension of the various components of the body segments 52A-B, and thus the contact body 52. The contact 50 can be constructed such that substantially nowhere from and between the first and second ends 54 and 56 do the thicknesses $T_2$ and $T_3$ exceed the thickness $T_1$ of the blank 46 of sheet metal 48. In this regard, it should be appreciated that while forming the body segments 52A-B, a bending operation for instance may create a localized thickness that is greater than the thickness $T_1$. However, because the thickness of the remainder of the body segments 52A-B is less than the thickness $T_1$, it can be said that substantially nowhere from and between the first and second ends 54 and 56 do the thicknesses $T_2$ and $T_3$ exceed the thickness $T_1$ of the blank 46 of sheet metal 48.

While the contact body 52 has been described as a one-piece contact body having the cable-interface end 54 integrally formed with the mating end 56 (and directly connected to the mating end or connected via the junction 58), it should be appreciated that the contact body 52 includes a one-piece first body segment 52A and a one-piece second body segment 52B that each define a portion of the mating end 56 configured to mate with a corresponding mating end of an electrical component, and a portion of the cable-interface end 54 configured to mate with a cable.

During operation of the contact 50, electrical signals or power travels from the cable 78, through the sleeve 60, junction 58, and casing 66, and into the external electrical component 40, where it can be transferred to external circuitry of, for instance, a printed circuit board 43. Because the sleeve opening 62 extends in the same direction as the receptacle openings 72 and 74, and the cable 78 and header connectors are received along parallel directions B and C, the contact 50 can be referred to as a vertical cable contact. A connector, such as the connector 42 that includes the contact, can thus be referred to as a vertical electrical connector.

Because each contact body segment 52A-B is integrally constructed, and integral with each other to form the one-piece contact body 52, additional welding operations are not needed to electrically couple the cable 78 to the contact body 52 and the electrical device mated with the contact body 52 at the mating end 56.

While the contact 50 has been illustrated and described in accordance with one embodiment, it should be appreciated that numerous variations could be made without departing from the spirit and scope of the present invention as defined by the appended claims. For instance, while the contact 50 can be provided as a one-piece contact as described above with reference to FIGS. 4A-C, the contact bodies 52A and 52B can alternatively be discretely attached to provide a two-piece, or multi-piece, electrical contact as will now be described below with reference to FIG. 5.

Figure 5:
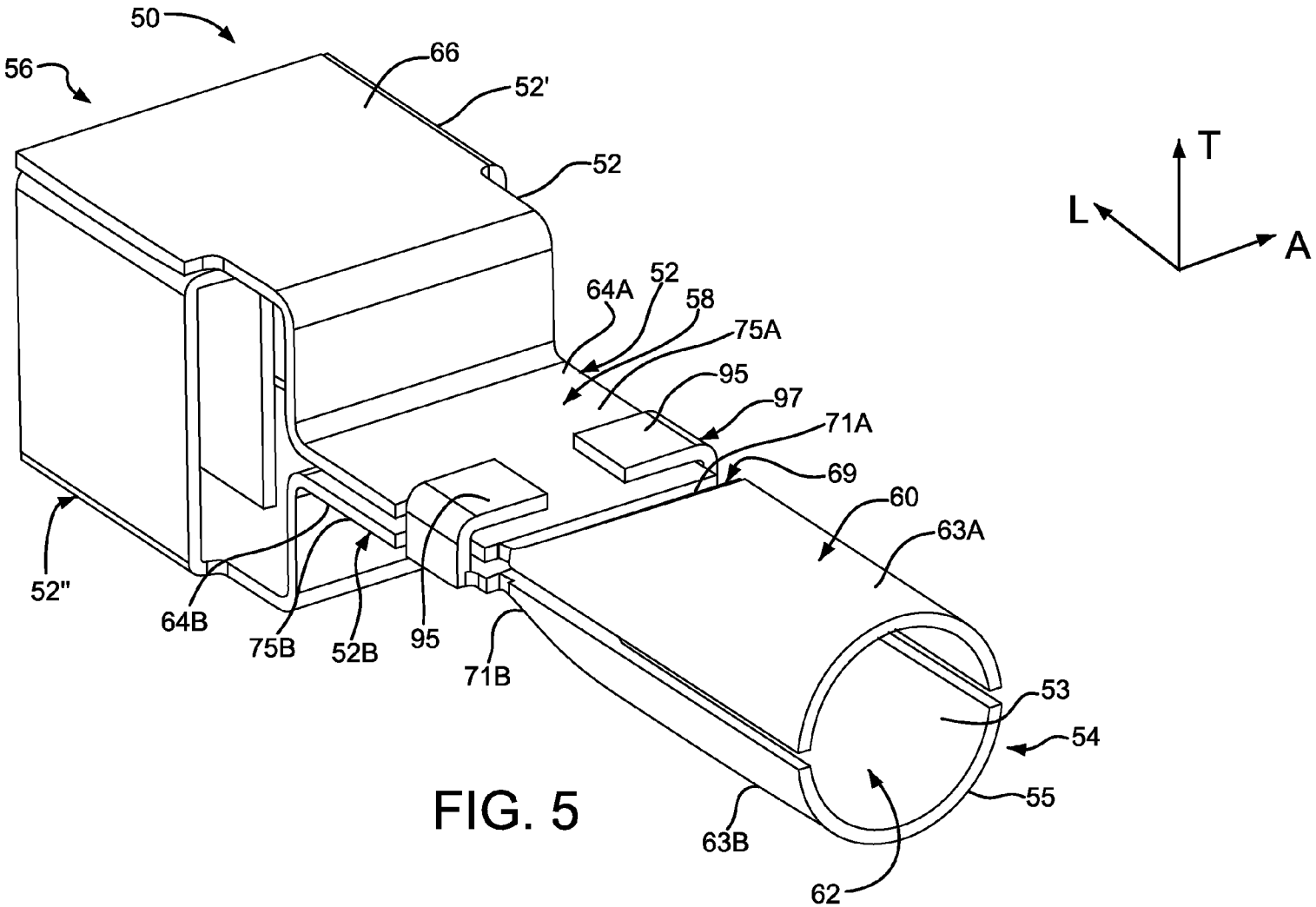
FIG. 5 is a perspective view of the vertical cable contact illustrated in FIG. 4A, but constructed from two blank sheets of metal of the type illustrated in FIG. 3B.

FIG. 5 illustrates the electrical contact 50 constructed as described above, however the contact 50 is provided as having a two-piece contact body 52 including contact body segments 52A and 52B. Thus, the contact 50 is devoid of any joints that integrally join the connector segments 52A and 52B, such as joint 55 described above with reference to FIGS. 4A-C. The pair of body segments 52A and 52B can each be individually fabricated using a unitary material, such as from the corresponding pair of blanks 46' of metal of the type illustrated in FIG. 3B. In particular, one of the blanks 46' can be used to construct the first body segment 52A, and another blank 46' can be used to construct the second body segment 52B. Accordingly, while each body segment 52A-B is integrally constructed, the first body segment 52A is not integrally connected to the second body segment 52B. Rather, the body segments 52A-B are fastened together using a junction lock 97 or other suitable fastener, such as one or more clasps, welding, or the like.

The junction lock 97 can include locking tabs 95 extending integrally out from one or both of the laterally opposing ends of one or both of the plates 64A-B. As illustrated, the locking tabs 95 extend out from the laterally opposing ends of the second plate 64B. The locking tabs 95 are positioned at the longitudinally upstream end of the junction 58 so as to further retain the arc-shaped segments 63A and 63B of the sleeve 60 in their desired position. During operation, the tabs 95 can be folded upward and laterally inward over the first plate 64A along the direction of Arrow F from an unlocked configuration (see, e.g., FIG. 9A) to the locked configuration illustrated as illustrated in FIG. 5. Accordingly, when the sleeve 60 is crimped around the cable 78, the locking tabs 95 of the junction lock resist separation of the plates 64A-B, for instance, due to forces produced during crimping of the sleeve 60.

While the junction lock 97 has been illustrated in accordance with one embodiment, any alternative locking mechanism suitable for assisting in maintaining the structural integrity of the contact body 52 is contemplated. For instance, the locking tabs 95 can be discretely coupled to the first and second body segments 52A and 52B, for instance, by clamping the locking tabs 95 around the plates 64A-B.

It should thus be appreciated that while the electrical contact 50 is provided as a multi-piece contact, the contact can be constructed without the need to weld components together as described above with respect to the electrical connector 20 described above. Thus, the contact 50 can allow for improved electrical current flow as opposed to conventional electrical contacts having portions that are discreetly connected (e.g., welded) to each other.

It should be further appreciated that numerous variations of the electrical contact 50 could be made without departing from the spirit and scope of the present invention as defined by the appended claims. For instance, referring to FIGS. 6A-C, an electrical cable contact 150 is provided for connecting a cable to an electrical component, which can be in the form of the electrical connector 41 that in turn attaches to a printed circuit board 43. The electrical contact 150 is illustrated having reference numerals corresponding to like structure of the contact 50 incremented by 100 for the purposes of clarity. Thus, the contact 150 can be constructed as described above with respect to contact 50 unless otherwise specified.

The contact body 152 includes a first contact body segment 152A that is illustrated as defining an upper portion 152' of the contact body 152 and the various components of the contact body 152, and a second contact body segment 152B that is illustrated as defining a lower portion 152" of the contact body 152 and the various components of the contact body 152. Thus, the components of the first body segment 152A can be referred to as "first" components, while the components of the second body segment 152B can be referred to as "second" components. It should further be appreciated in accordance with the illustrated embodiments that the "first" components can likewise be referred to as "upper" components, while the "second" components can likewise be referred to as "lower" components. However, because the construction and orientation of the contact body 152 can differ from the illustrated embodiment without departing from the spirit and scope of the present invention as defined by the appended claims, the "first" components should not be construed as limited to "upper" components, and the "second" components should not be construed as limited to "lower" components.

Figure 7A:
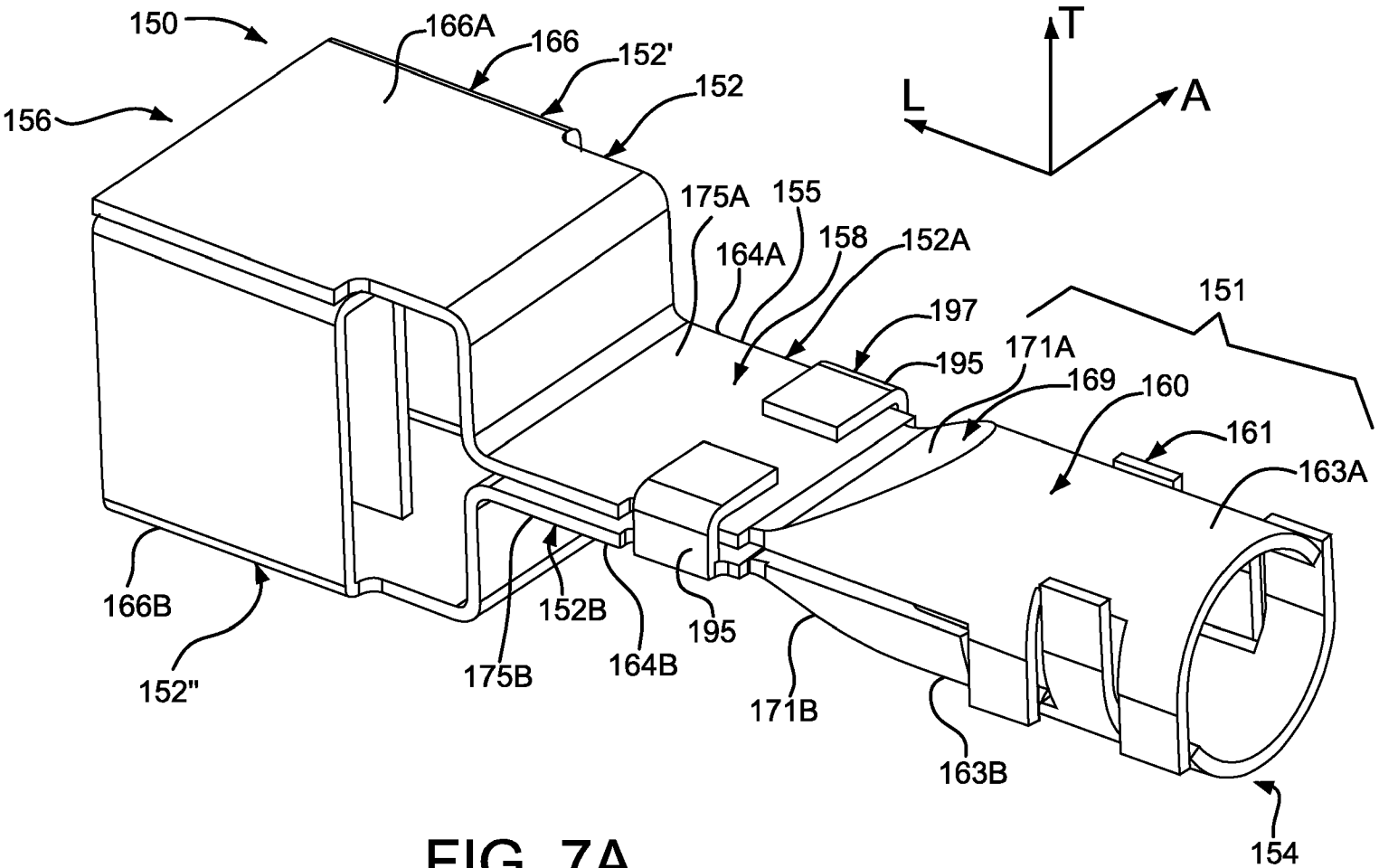
FIG. 7A is a perspective view of the vertical cable connector illustrated in FIG. 6A, but constructed from two blank sheets of metal of the type illustrated in FIG. 3B.
Figure 7B:
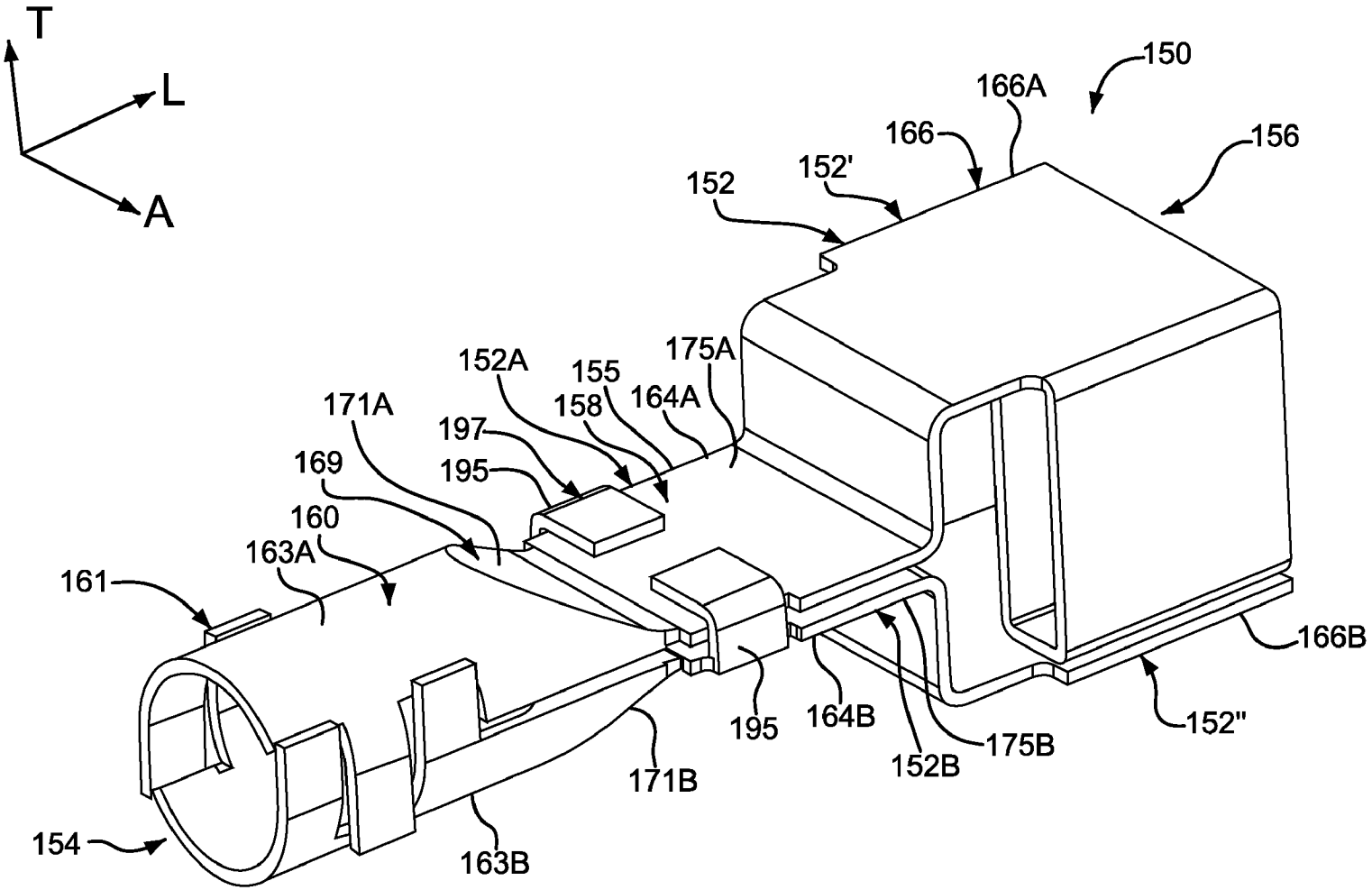
FIG. 7B is another perspective view of the vertical cable contact illustrated in FIG. 7A

The body segments 152A and 152B can be similarly or identically constructed and joined either discreetly or integrally to form the contact body 152. At least one, or both of, as illustrated, the first and second body segments 152A-B are integrally formed as a unitary structure. Thus, the contact body 152 can be formed from a unitary structure, such as the blank 46 of sheet metal 48 illustrated in FIG. 3A. Alternatively, the contact body 152 can be formed from several structures that are discretely connected together as illustrated in FIGS. 7A-B.

Thus, the body segments 152A and 152B each can be integrally formed as separate structures and then discretely connected together, or the body segments 152A and 152B can be integrally formed together from a single sheet of metal. Accordingly, the body segments 152A and 152B can be referred to as "one-piece" contact body segments. In the embodiment where the body segments 152A and 152B are integrally formed together, for instance from a single blank of sheet metal, the contact body 152, or contact 150, can be referred to as a "one-piece" contact body or contact.

The components of the integrally constructed contact body 152 will now be described. Because the body segments 152A and 152B are substantially identically or identically constructed, a description of a component of one of the segments applies to the corresponding structure of the other segment, unless otherwise specified. In this regard, it should be further appreciated that the components of the first body segment 152A are vertically inverted with respect to those of the second body segment 152B in the illustrated embodiment. It should also be appreciated that the structure of the contact body 152 is described herein in accordance with one embodiment, and that other suitable structure is contemplated as encompassed by the appended claims.

The cable-interface end 154 of the contact body 152 includes a sleeve 160 formed from opposing longitudinally extending arc-shaped bodies 163A and 163B. The arc-shaped bodies 163A-B in combination, impart a substantially tubular or alternatively shaped geometry to the sleeve 160 having a longitudinally elongate cavity 162 configured to receive a cable 78 therein along the direction of Arrow B, thereby allowing the cable-interface end 154 to mate with the cable 78. The cavity 162 defines an opening 153 disposed at the longitudinally upstream end of the cavity 162. The sleeve 160 defines a crimp zone 151 disposed between the transition zone 169 and the longitudinally upstream end of the sleeve 160. One or both of the sleeve segments 13A-B can be crimped against the cable 78 disposed in the cavity 162 to retain the cable 78 therein.

The sleeve 160 further includes a cable lock 161 that can be actuated to provide a retention force that locks the cable 78 in the opening 162 and prevents the cable 78 from being removed from the sleeve 160. The cable lock 161 includes a plurality of (or at least one) locking members 159 illustrated as outer and inner crimp tabs 165 and 167, respectively, that extend from the body segments 152A-B in an alternating and interdigitating manner. During operation, as described above, once the sleeve 160 has been crimped against the cable 78, the crimp tabs of the lock 161 can be squeezed, pressed, crimped, or otherwise secured against the crimped sleeve 160. Accordingly, the crimp tabs 165-167 resist forces that might tend to separate the sleeve 160 during use.

In particular, a pair of longitudinally spaced flexible crimp tabs 165A that extend down from one laterally outer edge of the arc-shaped body 163A, and a pair of longitudinally spaced flexible crimp tabs 165B that extend up from the opposing laterally outer edge of the arc-shaped body 163B. The lock 161 further includes a inner crimp tab 167B that extends up from the lateral edge of the arc-shaped body 163B that is opposite the edge from which the spaced crimp tabs 165B extend. Thus, the inner crimp tab 167B is positioned between the downwardly extending tabs 165A. The first body 163A includes a like inner crimp tab that extends down at a location between the upwardly extending crimp tabs 165B. The crimp tabs 165 and 167 are rectangular shaped, though they could alternatively assume any suitable geometric shape. The arc-shaped bodies 163A-B further include notches 184A and 184B sized and positioned to accommodate the opposing crimp tabs 165 and 167. While the crimp tabs 165 and 167 of each body segment 152A and 152B are illustrated as being in lateral alignment with each other, they can alternatively be laterally offset with respect to each other. Furthermore, it should be appreciated that the contact body 152 can include more than one sleeve 160 that is in electrical communication with the mating end 156, such that more than one cable can be placed in electrical communication with an electrical component.

Figure 6A:
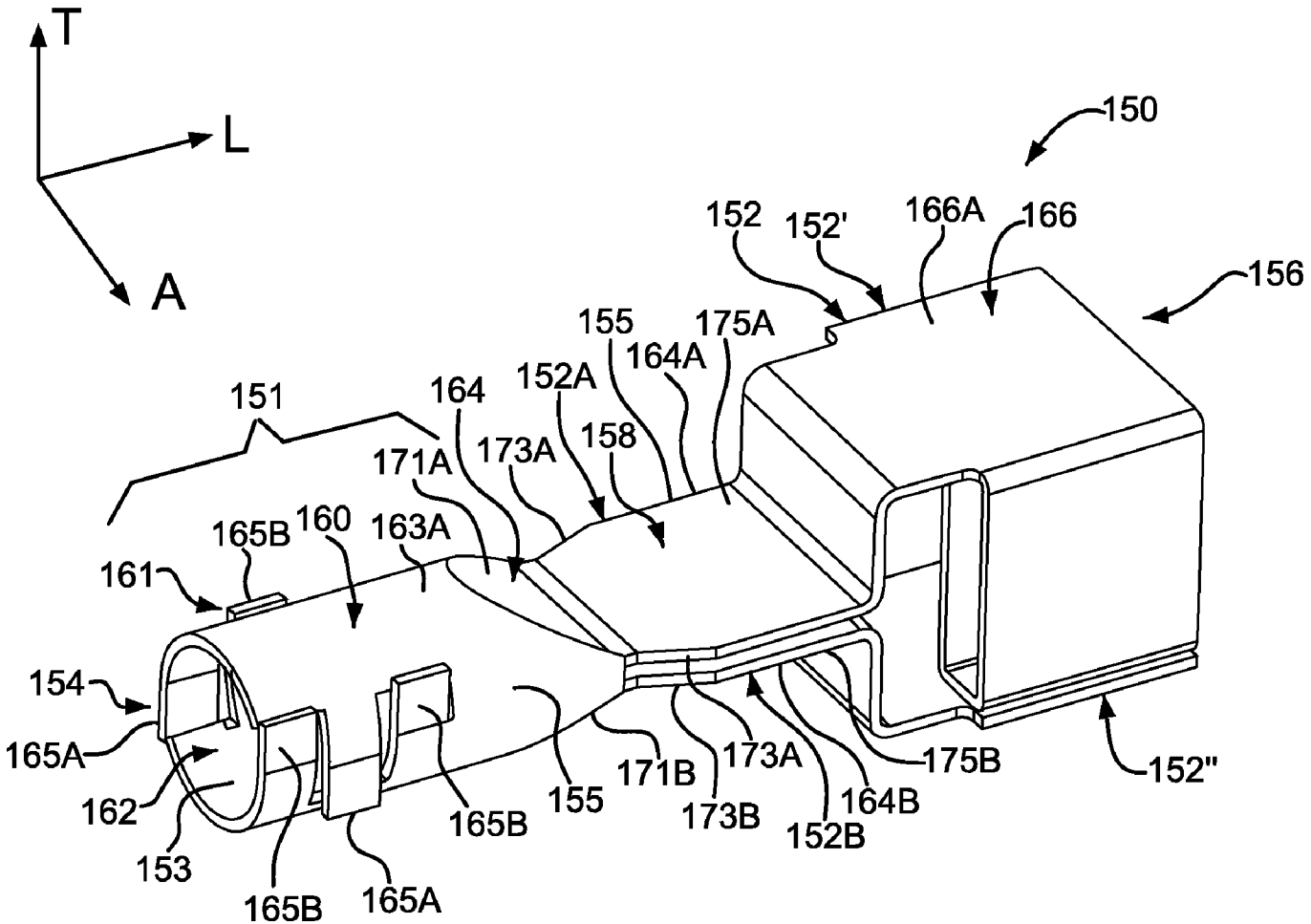
FIG. 6A is a perspective view of a vertical cable contact that can be constructed from the blank sheet of metal as illustrated in FIG. 3A in accordance with another embodiment.
Figure 6B:
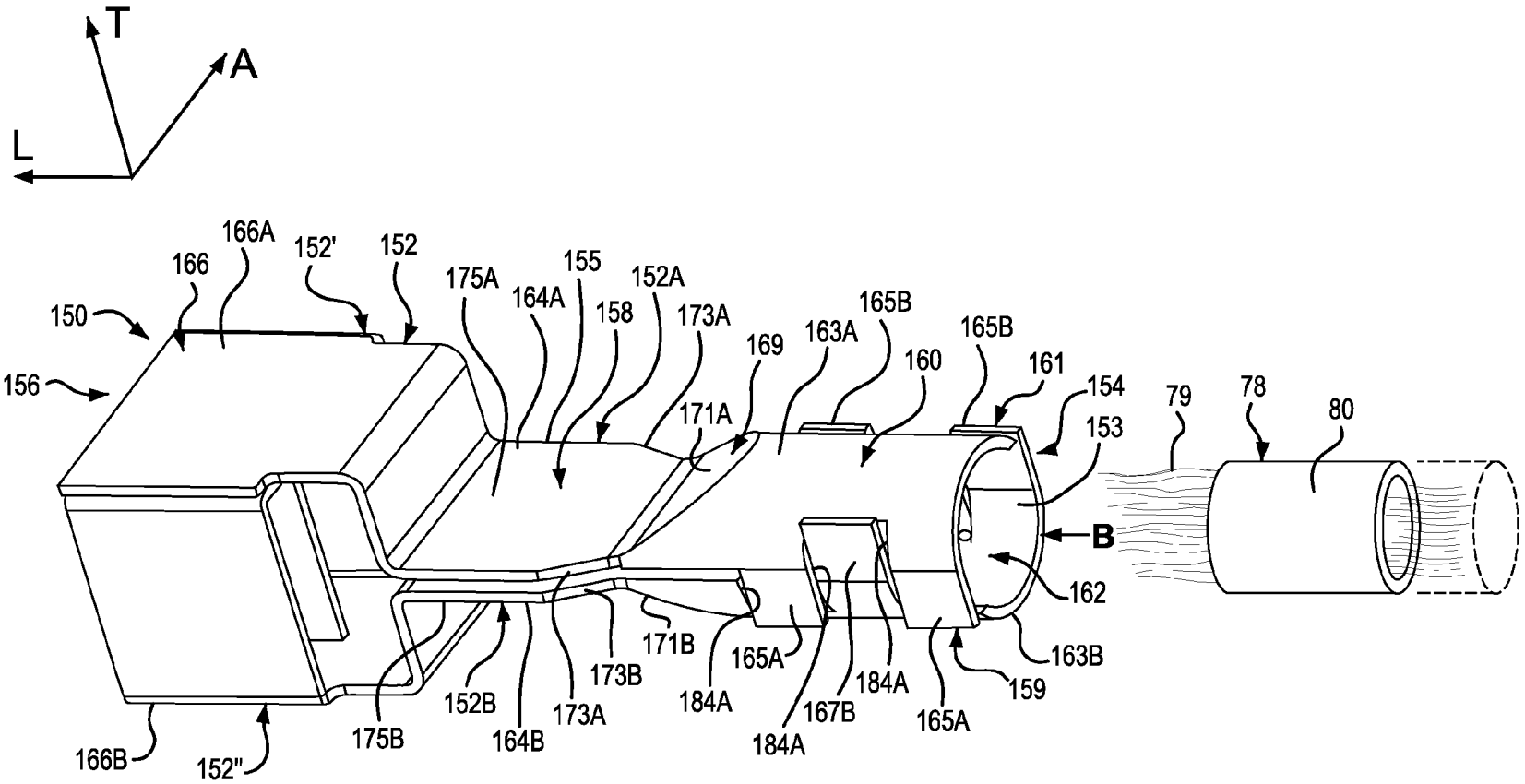
FIG. 6B is another perspective view of the vertical cable contact illustrated in FIG. 6A.
Figure 6C:
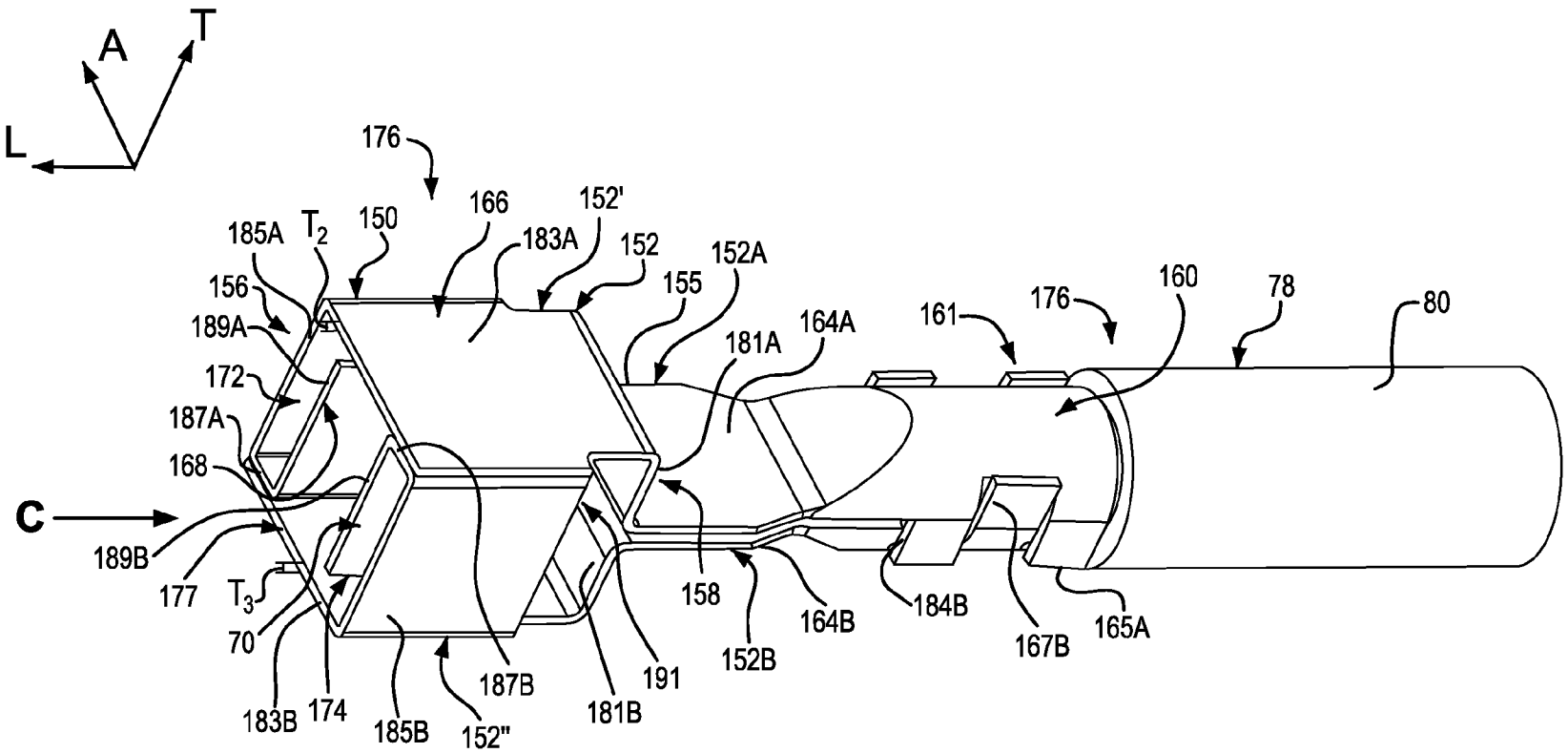
FIG. 6C is a perspective view of the cable contact illustrated in FIG. 6B connected to a cable.

With continuing reference to FIGS. 6A-6C, the sleeve 160 includes a transition zone 169 in the form of a beveled section at its longitudinally downstream end. The transition zone 169 includes first and second plates 171A and 171B that neck transversely inward from each body 163A and 163B, respectively, in a longitudinally downstream direction toward the junction 158. In this regard, the transition zone 169 is connected between, and provides an interface between, the sleeve 160 and the junction 158. While the transition zone 169 is illustrated as being substantially flat, it should be appreciated that any alternatively shaped interface suitable for directly or indirectly joining the sleeve 160 and the junction 158 is contemplated.

The joint 155 can extend longitudinally between the junction 58 and the longitudinally upstream end of the sleeve cable lock 161 (i.e., the longitudinally upstream-most crimp tab), though it should be appreciated that the joint 55 can alternatively be located anywhere, as desired, to integrally join the body segments 52A and 52B.

The longitudinally downstream end of the transition zone 169 is connected to the junction 158. The junction 158 includes a pair of flat horizontal plates 164A and 164B whose respective first and second surfaces abut or are in close proximity (vertical proximity as illustrated). Each plate 164A and 164B includes a corresponding body portion 175A and 175B and transition zones 173A and 173B, respectively, provided in the form of beveled sections. The transition zones 173A and 173B are disposed longitudinally upstream from the body portions 175A and 175B, and flare laterally outward in a longitudinally downstream direction from the neck 169 toward the body portions 175A and 175B.

The longitudinally upstream ends of the transition zones 173A and 173B have a lateral width substantially equal to that of the sleeve 160, while the longitudinally downstream ends of the transition zones 173A and 173B have a lateral width substantially equal to that of the body portions 175A and 175B. Thus the body portions 175A and 175B have a lateral width greater than that of the sleeve 160, and substantially equal to that of the mating end 156. It should be further appreciated that the junction 158 can include a lock of the type described above with respect to the junction lock 97 illustrated in FIG. 5 (see e.g., the lock 197 shown in FIGS. 7A-B).

The mating end 156 will now be described with reference to FIG. 6C, it being appreciated that the mating end 56 of the contact 50 can be constructed as described with reference to the mating end 156. In particular, the mating end 156 includes a casing 166 that defines at least one chamber 177, which in turn is illustrated as being divided into a pair of receptacles 168 and 170 that are laterally spaced from each other and define corresponding cavities 172 and 174, each configured to receive a mating end, for instance a header, of a corresponding external electrical component, such as the component 40 illustrated in FIGS. 1-2, or like component, in the longitudinal direction indicated by Arrow C. Each receptacle 168 and 170 can be rectangular in shape, or can define any alternative suitable shape as desired depending upon, for instance, the geometric configuration of the complementary header.

The casing 166 will now be described with reference to the first and second body segments 152A and 152B, it being appreciated that while certain directional terms used to describe the casing 166 and its components reflect the orientation of the casing 166 as illustrated for the purposes of clarity, the orientation of the casing 166 and its components could differ as desired. In particular, the casing 166 includes upper and lower vertical spacer walls 181A and 181B that extend vertically outward from the longitudinally downstream end of the plates 164A and 164B, respectively. The vertical spacer walls 181A-B are connected at their vertical outer ends to corresponding horizontal walls 183A-B that extend longitudinally downstream from the vertical spacer walls 181A-B.

Each horizontal wall 183A and 183B is connected at one lateral edge to a complementary first laterally outer vertical side wall 185A and second laterally outer vertical side wall 185B, respectively. In particular, the side wall 185A extends vertically down from the upper horizontal wall 183A at one side of the casing 156, and terminates at a distal end disposed immediately above the opposing lower horizontal wall 183B. Likewise, the opposing side wall 185B extends vertically up from the lower horizontal wall 183B at the other side of the casing 156 opposite to that of the side wall 185A, and terminates at a distal end disposed immediately below the upper horizontal wall 183A. The distal ends of the side walls 185A and 185B can abut the corresponding horizontal walls 183B and 183A, respectively, or be spaced from the horizontal walls as desired, it being appreciated that the vertical length of the side walls can define the height of the receptacles 168 and 170.

The respective lower and upper ends of the side walls 185A and 185B are connected to horizontal spacer walls 187A and 187B that extend horizontally, and specifically laterally inward, from the distal ends of the side walls 185A and 185B. The horizontal spacer walls 187A and 187B extend laterally inward from the side walls 185A and 185B a distance that up to substantially half, though illustrated as less than half, the total lateral width of the upper and lower horizontal walls 183A and 183B. To the extent that the horizontal spacer walls 187A and 187B terminate short of the lateral midpoint of the upper and lower walls 183A and 183B, the receptacles 168 and 170 will be spaced from each other accordingly. It should be further appreciated that the lateral distance of the walls 187A and 187B are illustrated as being identical, such that the receptacles 168 and 170 define identical lateral dimensions, however the walls 187A and 187B could alternatively extend laterally different distances such that the receptacles 168 and 170 have different lateral widths.

The distal ends of the lateral spacer walls 187A and 187B are connected to first and second laterally inner vertical side walls 189A and 189B, respectively. Inner side wall 189A extends up from the distal end of horizontal spacer wall 187A, and terminates at a distal end that is disposed below the upper horizontal wall 183A. Likewise, inner side wall 189B extends down from the distal end of horizontal spacer wall 187B, and terminates at a distal end that is disposed above the upper horizontal wall 183A. It should be appreciated that the distal ends of the side walls 189A-B can abut the respective horizontal walls 183B-A, or be vertically spaced from the respective horizontal walls 183B-A.

It should thus be appreciated that the upper and lower horizontal walls 183A-B and the outer side walls 185A-B define the chamber 171 that is divided into a pair of adjacent, divided, and laterally spaced receptacles 168 and 170. In particular, the receptacle 168 is defined by laterally spaced walls 185A and 189A, the lateral spacer wall 187A, the portion of the upper horizontal wall 183A that is disposed between the walls 185A and 189A, and the portions of the vertical spacer walls 181A-B that are disposed between the walls 185A and 189A. The receptacle 168 defines an internal cavity 172 defined by the downstream ends of the walls 185A, 189A, 187A, and the portion of wall 183A that is disposed between walls 185A and 189A.

Likewise, the receptacle 170 is defined by laterally spaced walls 185B and 189B, the lateral spacer wall 187B, the portion of the lower horizontal wall 183B that is disposed between the walls 185B and 189B, and the portions of the vertical spacer walls 181A-B that are disposed between the walls 185B and 189B. The receptacle 170 defines an internal cavity 174 defined by the downstream ends of the walls 185B, 189B, 187B, and the portion of wall 183B that is disposed between walls 185B and 189B.

It should be appreciated that the height of the receptacles 168 and 170 can be adjusted, for instance, by correspondingly adjusting the height of walls 185A-B, 189A-B and vertical spacer walls 181A-B. The lateral width of the receptacles 168 and 170 can be adjusted, for instance, by correspondingly adjusting the lateral widths of lateral spacer walls 187A-B. The depth (or longitudinal dimension) of the receptacles 168 and 170 can be adjusted, for instance, by correspondingly adjusting the longitudinal length of the upper and lower horizontal walls 183A and 183B.

In this regard, it should be appreciated that the walls 185A-B, 187A-B, and 189A-B may extend all the way to, and abut, the vertical spacer walls 181A-B, or can be lateral spaced from the vertical spacer walls. As illustrated, the walls 185A-B, 187A-B, and 189A-B are shown as spaced longitudinally downstream from the vertical spacer walls 181A-B so as to provide a laterally extending airflow channel 191 that is in fluid communication with the cavities 172 and 174 to assist in heat dissipation during operation.

It should be further appreciated that while the shape and dimension of the receptacles 168 and 170 and their respective cavities 172 and 174 are identically constructed as illustrated, they could alternatively be constructed differently from each other, for instance by altering the size and/or shape of any of the walls that define either or both the receptacles as desired.

Furthermore, while the contact body 152 has been described as constructed in accordance with one embodiment, it should be appreciated that the contact body could be modified in one of numerous ways without departing from the spirit and scope of the invention as defined by the appended claims. For instance, the chamber 177 can be configured to include one or more than two receptacles so as to electrically connect any desired number of electrical components to the cable 78. Likewise, the mating end 156 can alternatively include headers as opposed to receptacles 168 and 170 that are configured to mate with corresponding receptacles of the electrical component. Thus, when the mating end 156 is said to "mate" with a corresponding mating end of an electrical component, the mating end 156 can receive or be received in the mating end of the electrical component.

The operation of the contact 150 will now be described with continuing reference to FIGS. 6A-6C. In particular, the cable 78 is inserted along the longitudinal direction indicated by Arrow B until the cable is inserted into the cavity 162 of the sleeve 160. The sleeve 160 is then crimped onto the cable 78 at the crimp zone 151 to cause an interference that secures the cable 78 in the cavity 162, thereby forming a cable contact assembly 176. The cable lock 161 can then be actuated by squeezing, pressing, or otherwise bringing the crimp tabs against the crimped sleeve 160. Likewise, the header of an electrical component (such as the header 41 of the electrical component 40 or other suitable electrical component) can be inserted in each of the receptacles 168 and 170 which are geometrically configured to receive the headers. Because the lock 161 is integral with the contact body 152, additional welding operations are not needed to couple the cable 78 to the contact body 152.

While the contact body 152 has been described as a one-piece contact body having the cable-interface end 154 integrally formed with the mating end 156 (and directly connected to the mating end or connected via the junction 158), it should be appreciated that the contact body 152 includes a one-piece first body segment 152A and a one-piece second hosing segment 152B that each define a portion of the mating end 156 configured to mate with a corresponding mating end of an electrical component, and a portion of the cable-interface end 154 configured to mate with a cable.

It should thus be appreciated that the contact 150 is configured to electrically connect the cable 78 and an electrical component (such as the electrical component 140) in parallel (e.g., longitudinal) orientations. It should be further appreciated that because the lock 161 is integral with the contact body 152, additional welding operations are not needed to couple the cable 78 to the contact body 152. Because the receptacles 168 and 170 are integrally formed with the sleeve 160, once the cable 78 is secure in the sleeve 160, the cable is in electrical communication with the receptacles 168 and 170 and corresponding electrical devices 40 that are inserted into the receptacles 168 and 170, along with one or more circuit boards 43 that are connected to the electrical devices 40.

Furthermore, a one-piece contact body 152 (or one-piece body segments 152A and 152B) can allow for improved electrical current flow as opposed to contact body having portions that are discreetly connected (e.g., welded) to each other. Because the body segments 152A and 152B are formed from a sheet of metal, such as blank 46, the body segments 152A and 152B can each be constructed with a respective thickness $T_1$ (see FIG. 6C) defined as a dimension normal to the direction of extension of the various components of the body segments 152A and 152B. The body segments 152A and 152B, and thus the contact body 152, can be constructed such that nowhere from and between the first and second ends 154 and 156 does either thickness $T_2$ or $T_3$ exceed the thickness $T_1$ of the blank 46 of sheet metal 48.

In this manner, electrical signals or power travels from the cable 78, through the sleeve 160, junction 158, and casing 166, and into the external electrical component 40, where it can be transferred to external circuitry of, for instance, a printed circuit board 43. Because the sleeve opening 162 extends in the same direction as the receptacle openings 172 and 174, and the cable 78 and header connectors are received along parallel directions B and C, the contact 150 can be referred to as a vertical cable contact. A connector, such as the connector 42 that includes the contact 150, can thus be referred to as a vertical electrical connector.

While the contact 150 has been illustrated and described in accordance with one embodiment, it should be appreciated that numerous variations could be made without departing from the spirit and scope of the present invention as defined by the appended claims. For instance, while the contact body segments 152A and 152B are shown as being joined at joint 155, which defines a lateral end of the contact body 152 at the sleeve 160, it should be appreciated that a joint that joins the segments 152A and 152B could alternatively be positioned anywhere, for instance at a transverse or longitudinal end of the contact body 152. Thus, while the body segments 152A and 152B are illustrated as defining upper and lower ends of the contact body 152, the body segments 152A and 152B could alternatively be configured to provide alternative directional ends of the contact body 152.

Furthermore, while the contact 150 can be provided as a one-piece contact as described above with reference to FIGS. 6A-C, the contact bodies 152A and 152B can alternatively be discretely attached as will now be described with reference to FIGS. 7A-B.

FIGS. 7A-B illustrate the electrical contact 150 constructed as described above, however the contact 150 is provided as having a two-piece contact body 152 including contact body segments 152A and 152B. Thus, the contact 150 is devoid of any joints that integrally join the body segments 152A and 152B, such as the joint 155 described above with reference to FIGS. 6A-C. The pair of body segments 152A and 152B can each be individually fabricated using a unitary material, such as from the corresponding pair of blanks 46' of metal of the type illustrated in FIG. 3B. In particular, one of the blanks 46' can be used to construct the first body segment 152A, and another blank 46' can be used to construct the second body segment 152B. Accordingly, while each body segment 152A-B can be integrally constructed, the first body segment 152A is not integrally formed with the second body segment 152B. Rather, the body segments 152A-B are fastened together using a junction lock 197 or other suitable fastener, such as one or more clasps, welding, or the like.

The junction lock 197 can include locking tabs 195 extending integrally out from one or both of the laterally opposing ends of one or both of the plates 164A-B. As illustrated, the locking tabs 195 extend out from the laterally opposing ends of the second plate 164B. The locking tabs 195 are positioned at the longitudinally upstream end of the junction 158 so as to further retain the arc-shaped segments 163A and 163B of the sleeve 160 in their desired position. During operation, the tabs 195 can be folded upward and laterally inward over the first plate 164A along the direction of Arrow F from an unlocked configuration (see, e.g., FIG. 9A) to the locked configuration illustrated as illustrated in FIGS. 7A-B. Accordingly, when the sleeve 160 is crimped around the cable 178, the locking tabs 195 of the junction lock 197 resist separation of the plates 164A-B.

While the junction lock 197 has been illustrated in accordance with one embodiment, any alternative locking mechanism suitable for assisting in maintaining the structural integrity of the contact body 152 is contemplated. For instance, the locking tabs 195 can be discretely coupled to the first and second body segments 152A and 152B, for instance, by clamping the locking tabs 195 around the plates 164A-B.

It should thus be appreciated that while the electrical contact 150 is provided as a multi-piece contact, the contact can be constructed without the need to weld components together as described above with respect to the electrical connector 20 described above. Thus, the contact 150 can allow for improved electrical current flow as opposed to conventional electrical contacts having portions that are discreetly connected (e.g., welded) to each other.

Figure 8A:
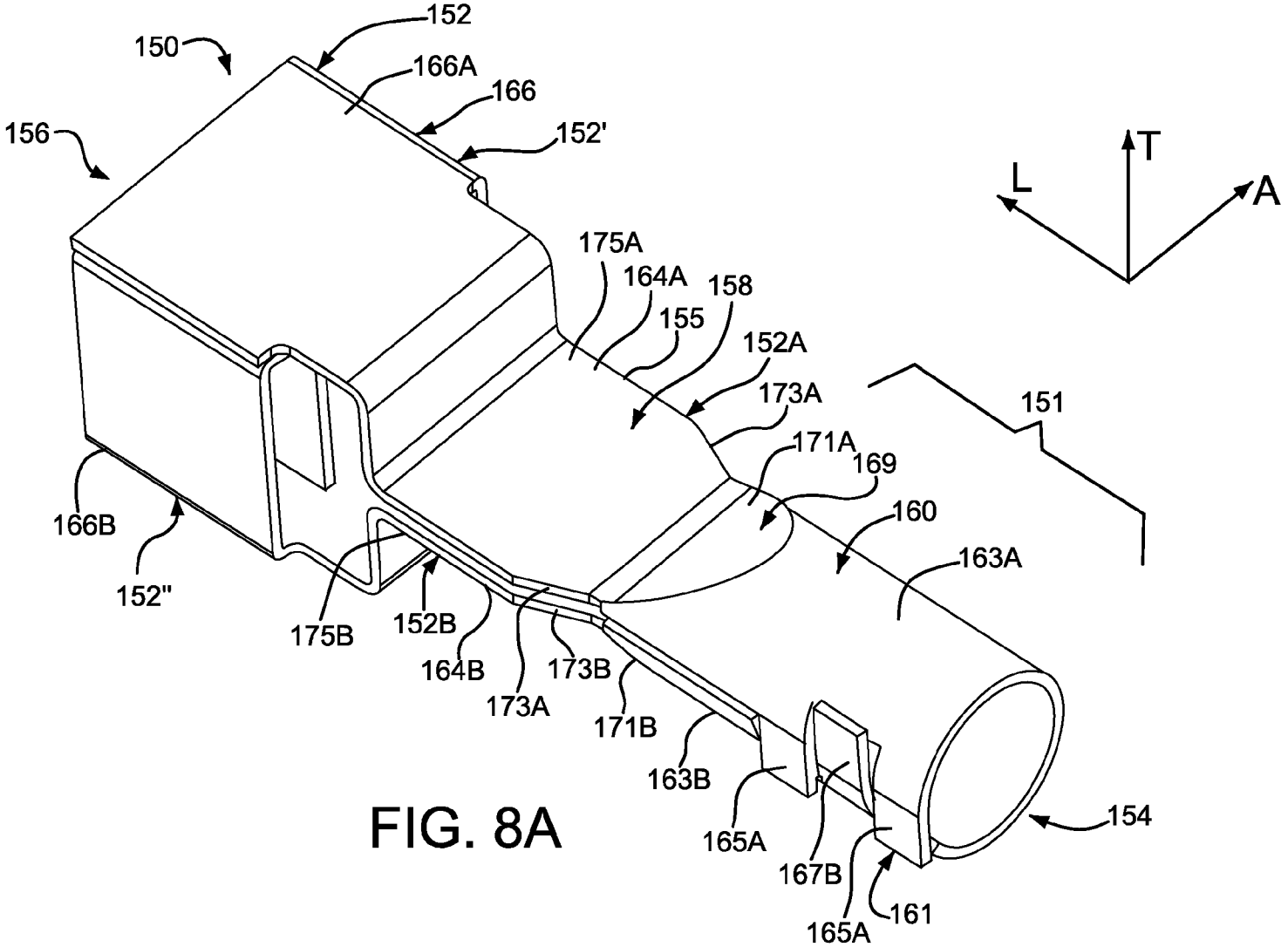
FIG. 8A is a perspective view of the vertical cable contact illustrated in FIG. 6A, but including a cable lock constructed in accordance with an alternative embodiment.
Figure 8B:
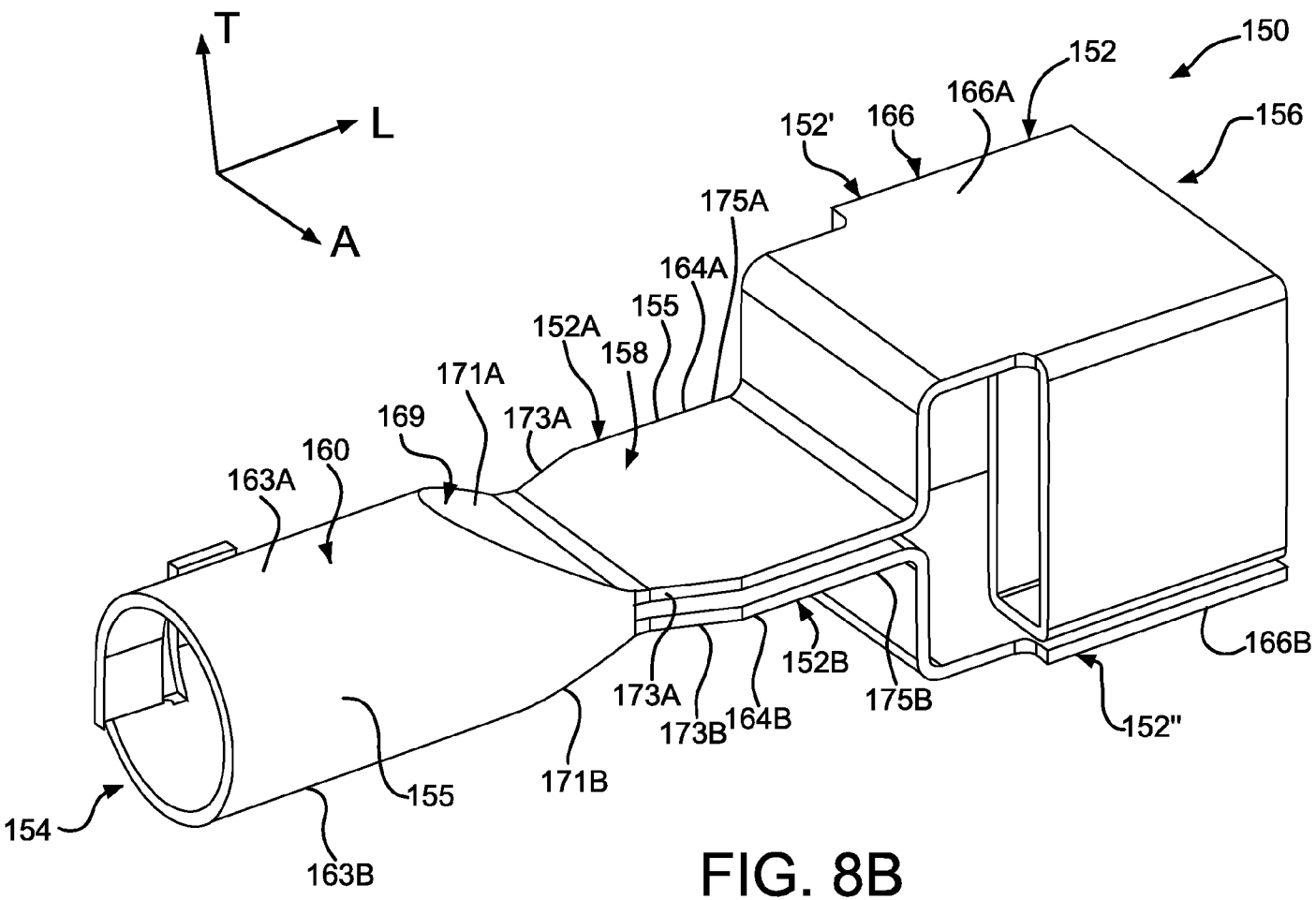
FIG. 8B is another perspective view of the vertical cable contact illustrated in FIG. 8A.

It should be further appreciated that numerous variations of the electrical contact 50 could be made without departing from the spirit and scope of the present invention as defined by the appended claims. For instance, referring to FIGS. 8A-B, the cable lock 161 described above with respect to the electrical connector 150 can be provided in accordance with any desirable alternative embodiment. As shown in FIGS. 8A-B, the lock 161 includes the crimp tabs 165A and 167B on one lateral side of the connector 150, while the opposing lateral side of the connector 150 is devoid of crimp tabs. Thus, the contact body segments 152A and 152B are integrally joined at the joint 155 which can extend from the longitudinally downstream end of the sleeve 160 to the longitudinally upstream end of the sleeve 160 (or between the junction 158 and the open end 153).

During operation, as described above, once the sleeve 160 has been crimped against the cable 78, the crimp tabs of the lock 161 can be squeezed, pressed, or otherwise secured against the crimped sleeve 160. Accordingly, the crimp tabs 165-167 resist forces that might tend to separate the sleeve 160 during use.

While the contacts 50 and 150 have been illustrated and described as vertical contacts, it should be appreciated that a right-angle contacts can also be provided. In particular, FIGS. 9A-9D illustrate that an electrical contact constructed in accordance with certain embodiments can be constructed as a right-angle cable contact 250 for connecting a cable to an electrical component, which can be in the form of an electrical connector that in turn attaches to a printed circuit board (not shown). Thus, when the contact 250 is disposed in a connector housing, the resulting electrical connector can be provided as a right-angle cable connector. The contact 250 is illustrated having reference numerals corresponding to like structure of the contact 150 incremented by 100 for the purposes of clarity. Thus, the contact 250 can be constructed as described above with respect to contact 150 unless otherwise specified.

Thus, the contact 250 includes a contact body 252 having a first cable-interface end 254, an opposing second mating end 256, and a junction 258 connected between the first and second ends 254 and 256. Each contact half 252A and 252B can be integrally formed and discreetly joined, and can furthermore include discrete components that are formed and subsequently joined together. Alternatively, as illustrated, the contact body 252, including both contact halves 252A and 252*b*, can be formed as a unitary structure. The ends 254 and 256, and the junction 258, are electrically conductive so as to place the mating end 256 in electrical communication with the cable interface end 254. The contact body 252 can be covered with an insulating dielectric material as desired.

The body segments 252A and 252B can each be individually fabricated using a unitary material, for instance a single piece of sheet metal such as the blanks 46' of sheet metal 48 illustrated in FIG. 3B, and fastened using the junction lock 297 or other suitable fastener, such as clasps, welding, or the like. It should be further appreciated that the contact body 252 can include the junction lock 297, if desired, when the body segments 252A and 252B are integrally constructed, for instance by bending a single piece of sheet metal at location 255 disposed at a lateral end of the junction 258, between the casing 266 and the junction lock 297, to create the first and second body segments 252A and 252B of a one-piece electrical contact.

The cable-interface end 254 extends in a direction that is angularly offset, and perpendicular as illustrated, with respect to the mating end 256. For instance, the mating end 256 and the junction are elongate in the longitudinal direction L, while the cable-interface end 254 is elongate in the lateral direction. Thus, the cable contact 250 can be referred to as a "right angle" contact. The ends 254 and 256, and the junction 258, are electrically conductive so as to place the mating end 256 in electrical communication with the cable interface end 254. The contact body 252 can be covered with an insulating dielectric material as desired.

In the illustrated embodiment, the contact body 252 includes a first body segment 252A that is illustrated as defining an upper half 252' of the contact body 252 and the various components of the contact body 252, and a second body segment 252B that is illustrated as defining a lower half 252" of the contact body 252 and the various components of the contact body. The body segments 252A and 252B can be similarly or identically constructed and joined either discreetly or integrally to form the contact body 252 as described above with respect to contact body 152.

Figure 9A:
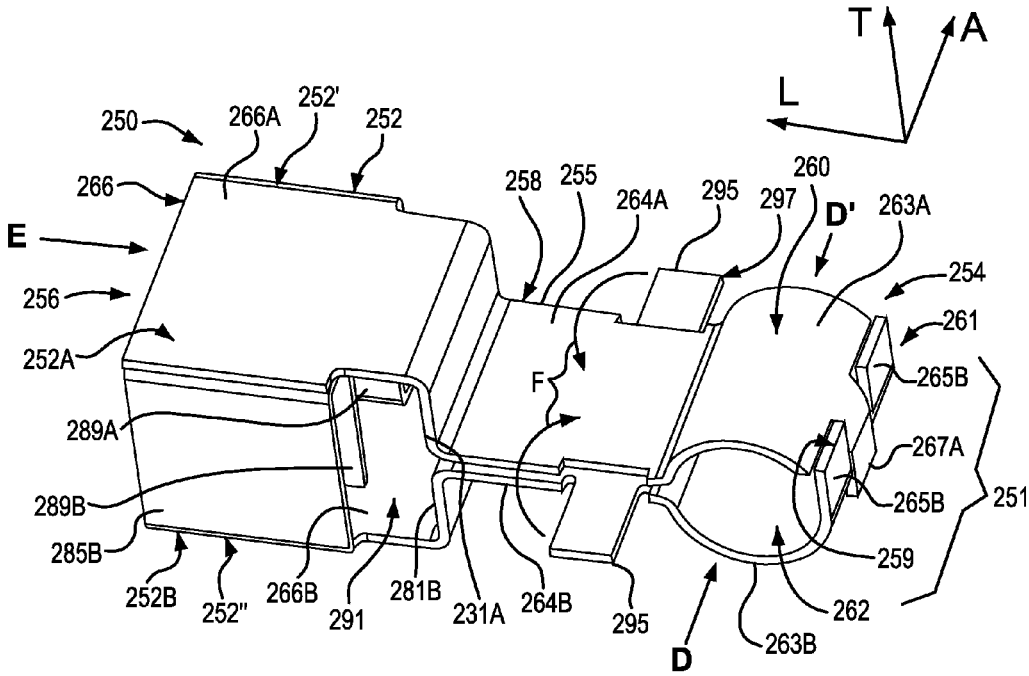
FIG. 9A is a perspective view of a right-angle cable contact constructed from two sheets of metal as illustrated in FIG. 3B in accordance with another embodiment, showing a junction lock in an unlocked configuration.
Figure 9B:
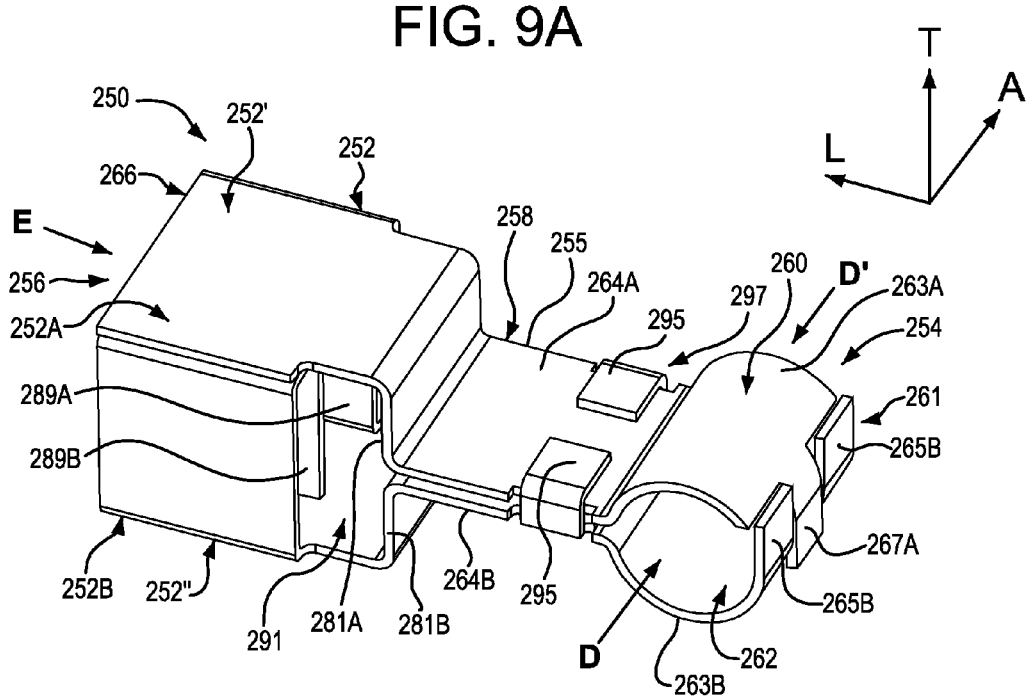
FIG. 9B is a perspective view of the right angle contact illustrated in FIG. 9A, but showing the junction lock in a locked configuration.
Figure 9C:
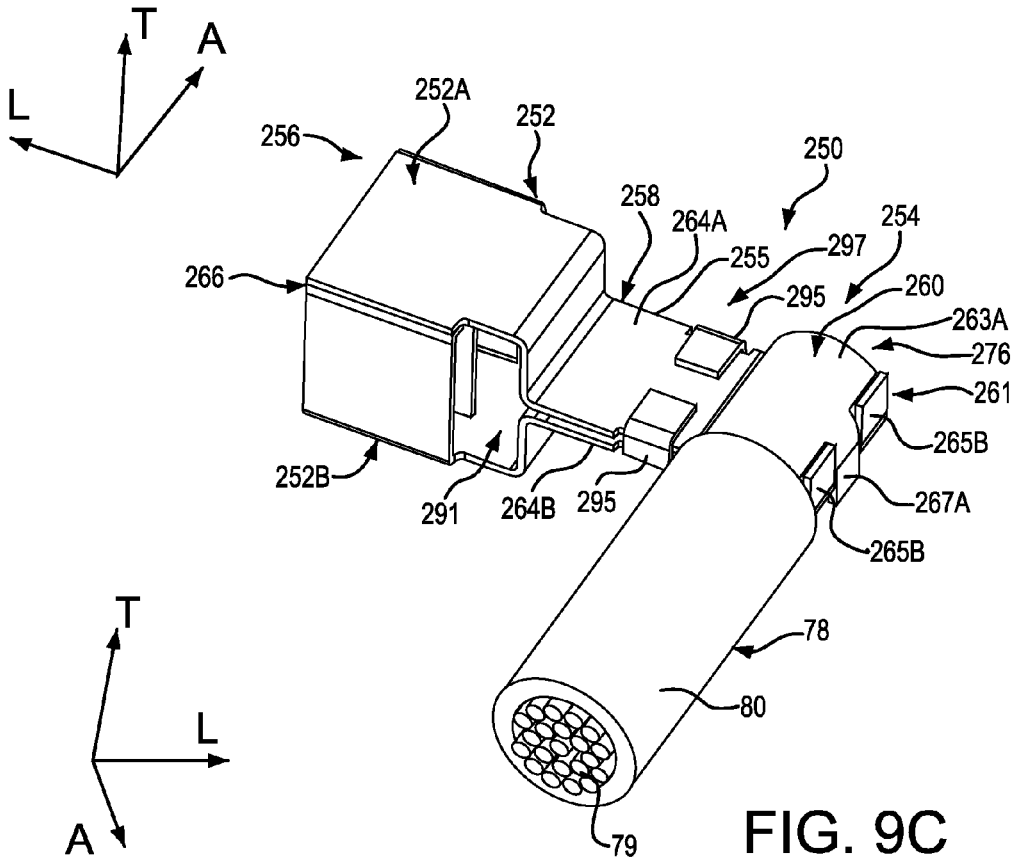
FIG. 9C is a perspective view of the right-angle cable contact as illustrated in FIG. 9B, but connected to a cable.
Figure 9D:
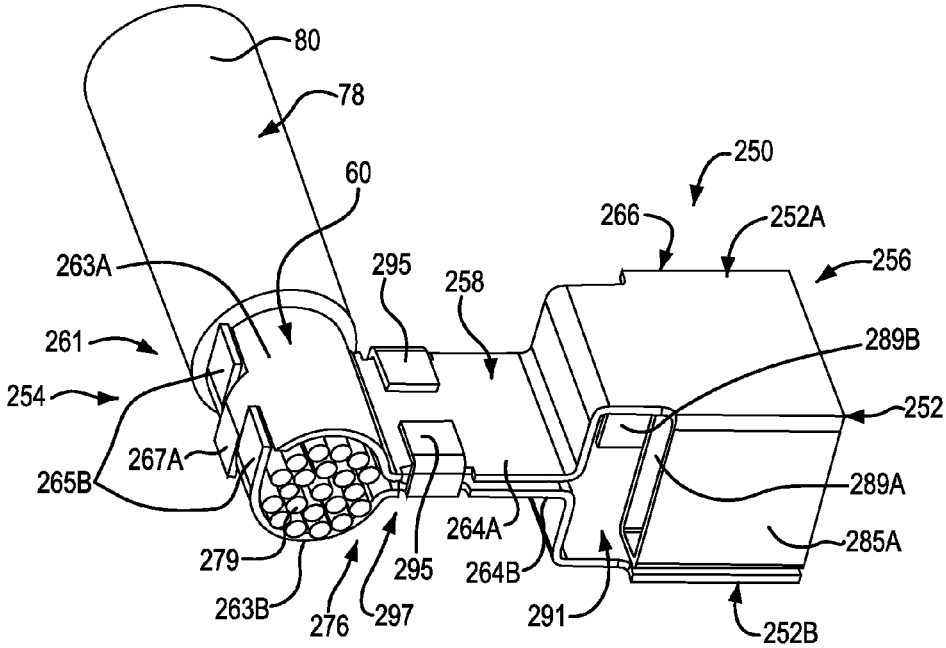
FIG. 9D is another perspective view of the right-angle cable contact illustrated in FIG. 9B, but connected to a cable.

The cable-interface end 254 of the contact body 252 includes a sleeve 260 formed from opposing longitudinally extending arc-shaped bodies 263A and 263B. The arc-shaped bodies 263A-B in combination, impart a substantially tubular or alternatively shaped geometry to the sleeve 260 having a laterally extending cavity 262 configured to receive fibers 79 of a cable 78 (see FIGS. 6A-B) therein. The cavity 262 defines open end 253 at each of its opposing lateral ends, and the cable 78 can be inserted into the cavity in either lateral direction as indicated by Arrows D and D'. FIGS. 9C-D show the cable 78 inserted into the sleeve along the direction indicated by Arrow D.

The longitudinally upstream end of the sleeve 260 is connected to the junction 258, while the longitudinally downstream end of the sleeve 260 includes a cable lock 261. The sleeve includes a crimp zone 251 disposed between the opposing lateral ends of the sleeve 260. One or both of the sleeve segments 263A-B can be crimped against the cable 78 disposed in the cavity 262 to retain the cable 78 therein. The cable lock includes a plurality of (or at least one) locking members 259 illustrated as crimp tabs 265B and 267A that extend from the body segments 252B and 252A, respectively, in an alternating and interdigitating manner.

In particular, a pair of longitudinally spaced flexible outer crimp tabs 265B extends up from the longitudinally downstream end of the arc-shaped body 263B, and an inner crimp tab 267A that extends down from the longitudinally downstream end of the arc-shaped body 263A at a location between the outer crimp tabs 265B. During operation, the sleeve 260 is crimped onto the cable 78 that is received inside the cavity 262, and the crimp tabs 265B and 267A can be squeezed, pressed, crimped, or otherwise secured against the crimped sleeve 260 to resist separation of the sleeve segments 263A-B.

The junction 258 can be constructed substantially as described above with respect to the junction 158 of the contact body 152. However, the flat plates 264A and 264B are illustrated as having the same lateral dimension as the sleeve 260, and thus do not include a transition zone. Of course, such a transition could be included as desired. The junction can include a junction lock 297 configured to retain the flat plates 264A and 264B together, for instance, when the body segments 252A and 252 are individually constructed. The junction lock 297 further resists separation of the plates 264A-B, for instance due to forces that can are produced when the sleeve 260 is crimped.

For instance, the junction lock 297 can include locking tabs 295 extending out from one or both of the laterally opposing ends of one or both of the plates 264A-B. As illustrated, the locking tabs 295 extend out from the laterally opposing ends of the second plate 264B. The locking tabs 295 are positioned at the longitudinally upstream end of the junction 258 so as to further retain the arc-shaped segments 263A and 263B of the sleeve 260 in their desired position after the sleeve 260 has been crimped. During operation, the tabs can be folded upward and laterally inward over the first plate 264A along the direction of Arrow F from an unlocked configuration illustrated in FIG. 9A to a locked configuration illustrated in FIG. 9B. While the junction lock 297 has been illustrated in accordance with one embodiment, any alternative locking mechanism suitable for assisting in maintaining the structural integrity of the contact body 252 is contemplated.

The junction 258 is connected to the casing 266 of the mating end 256 in the manner described above with respect to the contact 152. The mating end 256 can likewise be constructed as described above with respect to the mating end 156. Thus, the casing 266 defines a chamber as described above with respect to chamber 177, which in turn being divided into a pair of receptacles such as receptacles 168 and 170 that are laterally spaced from each other. The receptacles define corresponding cavities such as cavities 172 and 174 that are each configured to receive a header of a corresponding external electrical component, such as the component 40 or like component illustrated in FIGS. 1-2, in the longitudinal direction indicated by Arrow E. Thus, the electrical component is inserted into the contact body 252 in a direction that is angularly offset, and perpendicular, with respect to the angle at which the cable is inserted into the contact body 252.

In this manner, electrical signals or power travels from the cable 78, through the sleeve 260, junction 258, and casing 266, and into the external electrical component, where it can be transferred to external circuitry of, for instance, a printed circuit board. It should thus be appreciated that even though the contact body 252 is constructed by discretely joining the body segments 252A and 252B that have each been individually constructed, the components of the lock 261 are integral with their respective body segments 252A and 252B, and thus additional welding operations are not needed to couple the cable 78 to the contact body 252.

Figure 10A:
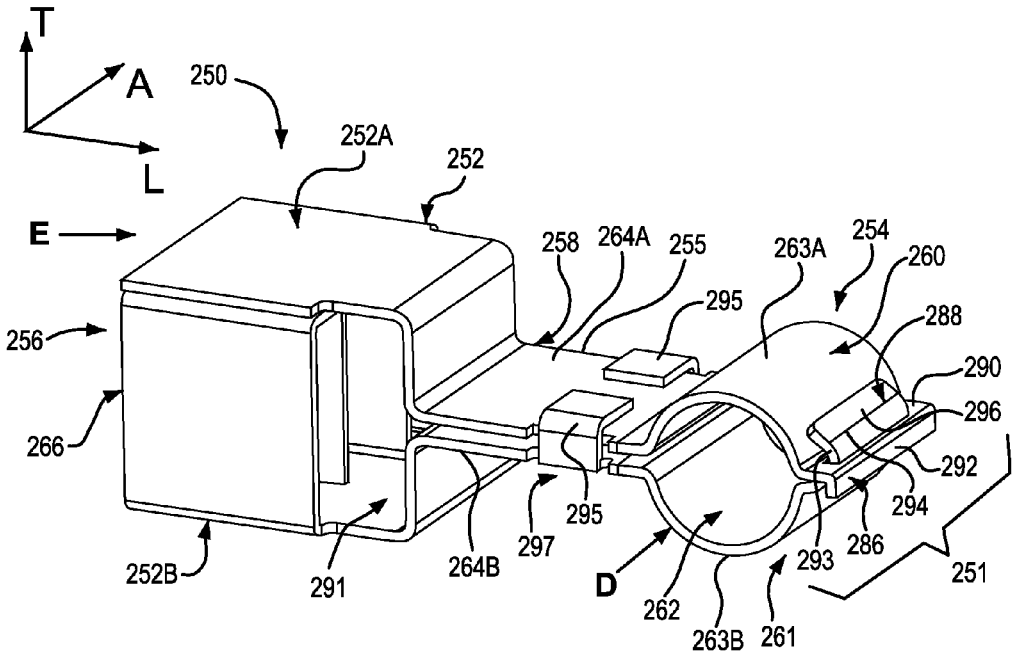
FIG. 10A is a perspective view showing the right-angle cable contact illustrated in FIG. 9A, but including a cable lock constructed in accordance with an alternative embodiment.
Figure 10B:
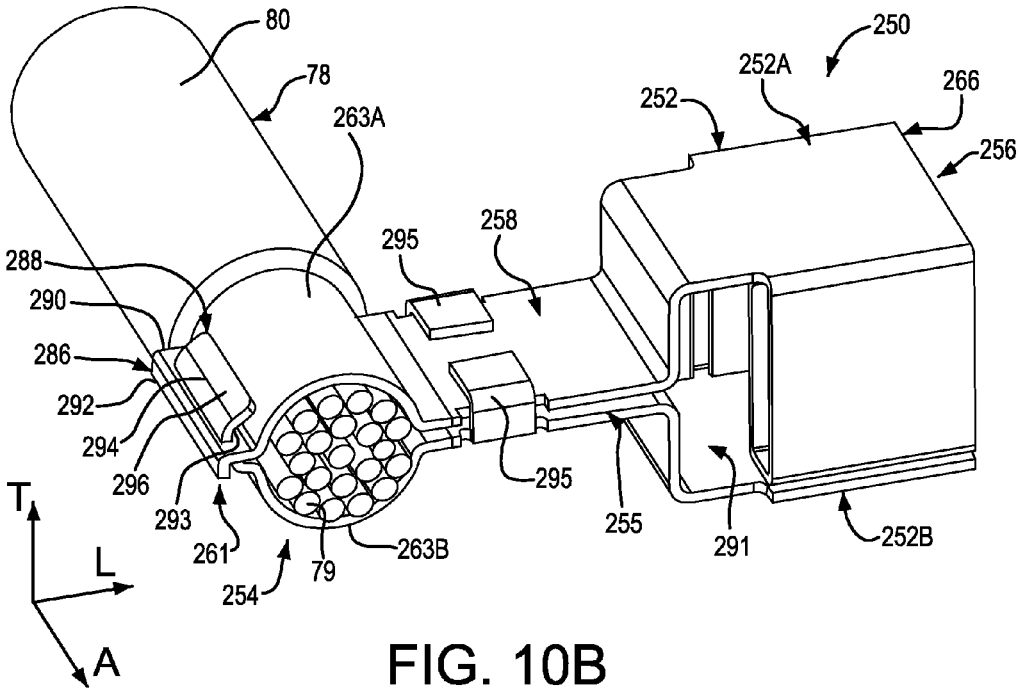
FIG. 10B is another perspective view of the right-angle cable contact illustrated in FIG. 10A.

Referring now to FIGS. 10A-B, it should be appreciated that the contact 250 can be configured in alternative suitable configurations. For instance, the cable lock 261 of the contact 250 is shown constructed in accordance with an alternative embodiment.

In particular, a first engagement member 286 can extend out from one segment 263A of the sleeve 260, and a second engagement member 288 can extend out from the other segment 263B of the sleeve 260. Of course, it should be appreciated that numerous alternative configurations are contemplated, including positioning the first engagement member 286 on the second segment 263B of the sleeve 260, and the second engagement member 288 on the segment 263A of the sleeve 260.

The first engagement member 286 can include a horizontal flange 290 that extends horizontally out from the longitudinally upstream end of the segment 263A. The first engagement member can further include a lip 292 that extends vertically down from the longitudinally upstream end of the flange 290. The lip 292 can provide an engagement surface when the lock 261 is actuated. The first engagement member 186 further includes a laterally elongate aperture 293 that extends vertically through the flange 290.

The second engagement member 288 includes a tab 294 that extends from the longitudinal upstream end of the segment 263B of the sleeve 260, and extends up through the aperture 293 of the flange 290. The tab 294 can have a lateral width substantially equal to or less than the width of the aperture 293, and can have a length that extends beyond the aperture 293 so as to define a gripping surface 296.

When the contact 250 is constructed as a one-piece contact in the manner described above, the tab 294 can extend in a straight direction and inserted into the aperture 293 when the contact 250 is bent about joint 255. When the contact 250 is constructed as a two-piece contact in the manner described above, the tab 294 can be pre-bent such that when the contact body segments 252A-B are attached, the tab 294 extends through the aperture 293. Once the sleeve is crimped against the cable 78, the tab 294 can be squeezed, pressed, crimped, or otherwise secured against the crimped sleeve 260 so as to resist forces that would tend to separate the sleeve segments 263A-B.

It should be appreciated that the embodiments described herein have been provided by way of example, and the scope present invention is not intended to be limited to the embodiments described herein. For instance, the features and structures described above with respect to one embodiment could be equally applied to, or incorporated in, any of the other embodiments described herein. In order to apprise the public of the scope of the present application, the following claims are presented.

What is claimed:

1. An electrical contact body defining a first end configured to mate with a cable and a second end configured to mate with an electrical component so as to place the cable in electrical communication with the electrical component, the contact body comprising:

a first segment defining a first portion of the first end and a first portion of the second end;

a second segment defining a second portion of the first end and a second portion of the second end, wherein at least one of the segments is a one-piece segment, and the first and second segments are attached such that the first end defines a sleeve configured to receive a cable; and a junction that is disposed between the first end and the second end, the junction including a junction lock that is spaced from the first end, integral with at least one of the first and second segments, and is configured to resist separation of the first and second segments.

2. The contact body as recited in claim 1, wherein the second end is configured to mate with the electrical component along a direction that is parallel to a direction along which the cable is received in the sleeve.

3. The contact body as recited in claim 1, wherein the second end is configured to mate with the electrical component along a direction that is perpendicular with respect to a direction along which the cable is received in the sleeve.

4. The contact body as recited in claim 1, wherein the first and second segments are each formed from a blank of sheet metal having a thickness, and each the first and second segments defines a corresponding a thickness that does not exceed the thickness of the blank of sheet metal across a substantial entirety of the first and second segments.

5. The contact body as recited in claim 1, wherein the first and second segments define respective upper and lower portions of the contact body.

6. The contact body as recited in claim 1, wherein the junction lock is integral with both of the first and second segments.

7. The electrical contact body as recited in claim 1, wherein the junction lock comprises first and second tabs that extend from both of the first and second segments, respectively.

8. The electrical contact body as recited in claim 1, wherein each of the locking tabs is configured to be folded over the other of the first and second segments so as to resist separation of the first and second segments.

9. The contact body as recited in claim 1, wherein each of the first and second segments comprise one-piece segments.

10. The contact body as recited in claim 9, wherein the contact body is a one-piece contact body.

11. The contact body as recited in claim 1, wherein the first and second segments are attached such that the second end defines a pair of spaced apart receptacles each configured to receive a corresponding header of the electrical component.

12. The contact body as recited in claim 11, wherein each of the spaced apart receptacles is substantially rectangular.

13. The electrical contact body as recited in claim 1, further comprising a cable lock configured to retain the cable in the sleeve.

14. The contact body as recited in claim 13, wherein the first and second segments comprise corresponding sleeve segments of the sleeve, and the cable lock comprises at least one crimp tab integrally formed with the sleeve segments, the crimp tabs being configured to become secured against the sleeve.

15. The electrical contact body as recited in claim 1, wherein the junction lock comprises at least one locking tab that extends from at least one of the first and second segments.

16. The electrical contact body as recited in claim 15, wherein the locking tab is configured to be folded over the other of the first and second segments so as to resist separation of the first and second segments.

17. The contact body as recited in claim 1, wherein the first and second segments are attached such that the second end defines at least one receptacle configured to receive a corresponding header of the electrical component.

18. The contact body as recited in claim 17, wherein the second end defines a pair of spaced apart receptacles each configured to receive a corresponding header of an electrical component.

19. An electrical contact configured to place a cable in electrical communication with an electrical component, the electrical contact comprising:

a one-piece contact body including a sleeve configured to receive the cable along a first direction, a receptacle configured to receive a corresponding mating end of the electrical component along a second direction that is substantially perpendicular with respect to the first direction, and a cable lock configured to retain the cable in the sleeve.

20. The electrical contact as recited in claim 19, wherein the one-piece contact body comprises first and second segments that each define a portion of the sleeve, and the cable lock includes at least one crimp tab integrally formed with each of the first and second segments, the crimp tabs being operable to become secured against the sleeve.

21. The electrical contact as recited in claim 19, wherein the receptacle further comprises a pair of spaced apart receptacles each configured to receive a corresponding mating end of the electrical component.

22. The electrical contact recited in claim 21, wherein each of the spaced apart receptacles is substantially rectangular.

23. A one-piece electrical contact configured to place a cable in electrical communication with an electrical component, the electrical contact comprising:

a first one-piece contact body segment integrally formed with a second one-piece contact body segment, wherein each contact body segment forms a portion of 1) a pair of spaced apart receptacles each configured to receive a corresponding header of an electrical component, 2) a sleeve configured to receive a cable, and 3) a cable lock configured to provide a retention force that is configured to retain the cable in the sleeve.

24. The one-piece electrical contact as recited in claim 23, further comprising a junction disposed between the receptacles to the sleeve, wherein the junction resists separation of the first and second contact bodies.

25. The one-piece electrical contact as recited in claim 23, wherein the sleeve is configured to receive the cable along a first direction, and the receptacles are each configured to receive the corresponding headers along a second direction that is substantially perpendicular with respect to the first direction.

26. The one-piece electrical contact as recited in claim 23, wherein each of the spaced apart receptacles is substantially rectangular.

* * * * *